US008025208B2

(12) United States Patent
Wisecarver et al.

(10) Patent No.: US 8,025,208 B2
(45) Date of Patent: Sep. 27, 2011

(54) BULK CONTAINER FOR LIQUID AND SEMI-LIQUID FLUID

(75) Inventors: Mark Anthony Wisecarver, Morristown, TN (US); Michael A. Churvis, Germantown, TN (US)

(73) Assignee: International Paper Company, Memphis, TN (US)

( * ) Notice: Subject to any disclaimer, the term of this patent is extended or adjusted under 35 U.S.C. 154(b) by 87 days.

(21) Appl. No.: 12/471,949

(22) Filed: May 26, 2009

(65) Prior Publication Data

US 2010/0301106 A1 Dec. 2, 2010

(51) Int. Cl.
*B65D 5/74* (2006.01)
*B65D 5/56* (2006.01)

(52) U.S. Cl. ..... 229/117.3; 222/105; 222/183; 229/109; 229/122.33; 229/122.34; 229/125.22; 229/125.26

(58) Field of Classification Search ..... 229/109, 229/122.32, 122.33, 122.34, 125.22, 125.26, 229/920, 117.3, 117.34, 117.35, 939; 206/386, 206/600

See application file for complete search history.

(56) References Cited

U.S. PATENT DOCUMENTS 2,946,494 A * 7/1960 Kuss ..... 229/117.3
2,962,159 A 11/1960 Sheard
3,012,660 A 12/1961 Sheldon
3,433,400 A 3/1969 Hawkins
3,907,194 A 9/1975 Davenport et al.
3,937,392 A 2/1976 Swisher
4,013,168 A 3/1977 Bamburg et al.
4,094,455 A 6/1978 Bamburg et al.
4,208,954 A 6/1980 Chase
4,341,337 A 7/1982 Beach et al.
4,359,182 A 11/1982 Perkins
4,421,253 A 12/1983 Croley
4,516,692 A 5/1985 Croley
4,585,143 A 4/1986 Fremow et al.
4,623,075 A * 11/1986 Riley ..... 222/183
4,666,059 A 5/1987 Nordstrom
4,742,951 A 5/1988 Kelly et al.
4,771,917 A 9/1988 Heaps, Jr. et al.
4,850,506 A 7/1989 Heaps, Jr. et al.
4,890,756 A 1/1990 Waltke
4,919,306 A 4/1990 Heaps et al.
5,050,775 A * 9/1991 Marquardt ..... 222/105
5,069,359 A 12/1991 Liebel
5,348,186 A 9/1994 Baker
5,351,849 A 10/1994 Jagenburg et al.

(Continued)

*Primary Examiner* — Gary Elkins
(74) *Attorney, Agent, or Firm* — Matthew M. Eslami

(57) ABSTRACT

A bulk container for storing, shipping and dispensing liquid and semi-liquid fluids comprises a bin having a sidewall, a closed bottom, and an open top. The sidewall comprises a plurality of interconnected sidewall panels extending at an angle with respect to one another. A lid is covering the open top of the bin and having a discharge opening therethrough adjacent one side edge thereof. A fluid-containing bag is supported in the bin and a discharge valve is on an upper end of the bag where the discharge valve is positioned to extend through the discharge opening. Valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening.

22 Claims, 41 Drawing Sheets

U.S. PATENT DOCUMENTS 5,474,203 A * 12/1995 Baker ..... 222/105
5,803,346 A 9/1998 Baker et al.
7,172,108 B2 * 2/2007 Ingalls ..... 229/117.3
7,275,679 B2 * 10/2007 Ingalls ..... 229/117.3
2003/0160092 A1 * 8/2003 Philips et al. ..... 229/122.32
2005/0051611 A1 3/2005 Ingalls
2006/0180643 A1 8/2006 Stephenson
2008/0023359 A1 1/2008 Churvis et al.

* cited by examiner

BULK CONTAINER FOR LIQUID AND SEMI-LIQUID FLUID

FIELD OF THE INVENTION

This invention relates to bulk shipping containers, and more particularly to a multi-sided shipping container in drum form made of corrugated fiberboard to replace the plastic, fiber or metal cylindrical shipping drums conventionally used.

BACKGROUND OF THE INVENTION

Containers of relatively large size are commonly used for the bulk transportation and storage of materials such as, e.g., solvents, lubricants, inks, dyes, abrasives, adhesives, resin, insecticides, dry chemicals, powdered detergents, grains, frozen concentrate, meat, spices, sauces, and the like. These bulk containers must be capable of withstanding the weight of the contents as well as the rough handling to which they may be subjected. Further, they should be capable of being handled with mechanized equipment, and should be capable of being stacked on top of one another.

A bulk container commonly in use comprises a cylindrical drum made of solid fiber, plastic or metal. These drums typically are provided in sizes 35 to 55 gallons and have metal rings or bands at their top and bottom ends, with a lid or cover removably secured in place by a clamping band. The drums can be picked up and transported by mechanized equipment, including engaging the tines of a forklift under the rim provided by the band at the top of the drum. They also may be manually moved around on a supporting surface by tilting the drum and rolling the bottom edge of it along the supporting surface.

Depending upon the product stored in them, when full these cylindrical drums can weigh upwards of 500 pounds. Accordingly, manual handling of them can be difficult, especially when they are tilted and rolled along a supporting surface, since the metal band at the top does not provide much surface to grip and control the drum. Moreover, the circular configuration at the bottom end enables momentum or inertia to be built up when the drum is being rolled, making it difficult to control.

Further, due to their construction, cylindrical drums must be fully assembled and shipped to a user in their normal usable configuration. This requires substantial storage and shipping space for empty drums, adding to freight and warehousing costs. In addition, these types of drums are not easily recyclable.

Accordingly, there is a need for an affordable, functional bulk container for liquids and semi-liquid fluids that has the advantages of a cylindrical drum but that is free of the disadvantages.

SUMMARY OF THE INVENTION

The invention is a multi-sided bulk shipping container for liquids and semi-liquid fluids in drum form made of corrugated fiberboard and that generally looks, handles, stores, ships, and can be received like the fiber, plastic or steel cylindrical drums conventionally used. It may be moved with a hand truck, clamp truck, or forklift, and may be manually rolled on its bottom edge. It has superior stacking strength, with a top to bottom compression of 6,000 pounds, and may be stacked three high with a safety factor of 5:1. The container of the invention is easily and fully recyclable and when empty the container of the invention may be shipped and stored in a knocked-down or flattened condition, although it can be shipped in fully assembled condition, if desired. The container can be provided in a variety of sizes and footprints, and preferably is designed with a footprint so that four of the containers fit side-by-side on a 40×48, 45×48 or 44×44 inch pallet. To fit on the different size pallets, the footprint of the container could be selected as necessary and the height changed, for example, to accommodate a desired capacity.

Integral rim structure at the top end of the container enables the container to be picked up and carried by engaging the tines of a forklift under the rim, and the container may be manually moved by tilting and rolling it on its bottom edge. Since the container of the invention is multi-sided rather than cylindrical, the rim formed at the top has a plurality of short straight sides corresponding to the number of sides of the drum, defining a larger and more secure surface for lifting the drum by engaging the tines of a forklift under the rim than does the rim at the top of a conventional cylindrical drum. Further, this larger rim provides a larger surface for gripping and control when the container is being manually moved by tilting and rolling it on its bottom edge, and the plurality of short straight sides or surfaces provided by the multi-sided construction retards the build-up of momentum or inertia when the container is tilted and rolled on its bottom edge, thereby enhancing control over the container when it is being moved manually.

The simplest form of container according to the invention comprises a multi-sided bin or case with a closed bottom or bottom wall and an open top, and a cover or lid for placement over the open top. This form of the invention could be used, for example, when the product placed in the container poses little risk of leakage, or when a bag is placed in the bin to contain the product, such as when the product comprises a liquid or semi-liquid material. In a preferred embodiment, the bin is octagonal in shape, with eight relatively narrow straight sides, and preferably made of triplewall corrugated fiberboard. The relatively narrow side panels of the octagonal shape provide superior flexural rigidity and stacking strength, and also results in a plurality of relatively short straight surfaces in a circumferential direction of the container, facilitating manual rolling of the container on its bottom edge. An outer rim at the upper end of the bin follows the contour of the octagonal shape and thus has a plurality of straight sections presenting downwardly facing shoulders that can be securely engaged with the tines of a forklift. Moreover, since the rim extends on all eight sides of the container it is easily accessed for all fork truck approaches to the container. The bottom of the bin is constructed so that it is strong and leak-resistant and preferably so that it provides a flat smooth surface on both the interior and exterior of the bin. Means on the bin and lid form locking structure that may be interlocked for locking the lid to the bin, if desired.

In a further preferred embodiment, a tray is placed in the bottom of the bin and an open-ended liner is seated in the tray and extends the full height of the bin. This aspect of the invention provides a leak-proof container without using a bag, but a bag may be used if desired. The cover, liner and tray may be of single wall construction or other suitable construction as desired or necessary.

In an alternate preferred embodiment the liner terminates short of the upper end of the bin and a shock-absorbing and force distributing pad is placed in the bin between the lid and the top end of the liner. The pad strengthens and reinforces the upper end of the container against opening in the event the container is tipped over onto its side and preferably is of triplewall construction.

Accordingly, one aspect of the present invention relates to a bulk container for storing, shipping and dispensing liquid and semi-liquid fluids comprises a bin having a sidewall, a closed bottom, and an open top. The sidewall comprises a plurality of interconnected sidewall panels extending at an angle with respect to one another. A lid is covering the open top of the bin and having a discharge opening therethrough adjacent one side edge thereof. A fluid-containing bag is supported in the bin and a discharge valve is on an upper end of the bag where the discharge valve is positioned to extend through the discharge opening. Valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening.

a liner insert is in the container, the liner insert fitting closely in the bin sidewall and extending from the bin closed bottom to the bin open top, the bag being confined within the liner insert. The valve support means comprises transverse means extending across an upper end of the liner insert, and the valve support opening extends through the transverse means adjacent a side edge thereof The liner insert is substantially coextensive in height with the bin sidewall and extends at the upper end thereof to the open top of the bin and the transverse means includes a valve support tray attached to the upper end of the liner insert. The locking means comprises a substantially flat, disc-shaped locking pad on top of the tray, the locking pad having an opening therethrough in aligned registry with the narrow end of the valve support opening, an edge of the opening through the locking pad engaging a side of the discharge valve to hold it in position in aligned registry with the discharge opening through the lid.

Another aspect of the present invention relates to a bulk container for storing, shipping and dispensing liquid and semi-liquid fluids comprises a bin having a sidewall, a closed bottom, and an open top. The sidewall comprises a plurality of interconnected sidewall panels extending at an angle with respect to one another. A lid is covering the open top of the bin, the lid having a discharge opening therethrough adjacent one side edge thereof A fluid-containing bag is supported in the bin. A discharge valve is on an upper end of the bag, the discharge valve is positioned to extend through the discharge opening. Valve support means in an upper end of the bin for supporting and holding the discharge valve in position to extend through the discharge opening. The valve support means having a valve support opening therethrough with an elongate generally keyhole shape that is wide at one end and narrow at the other end. The narrow end is aligned with the discharge opening through the lid, the discharge valve is received through the narrow end of the valve support opening, and locking means is engaged with the discharge valve to hold it in the narrow end of the valve support opening. A liner insert is in the container, the liner insert is fitting closely in the bin sidewall and is extending from the bin closed bottom to the bin open top, the bag is confined within the liner insert, the liner insert is shorter in height than bin sidewall and terminates at its upper end in downwardly spaced relationship to the open top. The valve support means comprises transverse means extending across an upper end of the liner insert, the transverse means comprises a valve support plate resting on the upper end of the liner insert, the valve support plate being engaged and held between the lid and the upper end of the liner insert.

A further aspect of the present invention relates a bulk container for storing, shipping and dispensing liquid and semi-liquid fluids comprises a bin having a sidewall, a closed bottom, and an open top. The sidewall comprising a plurality of interconnected sidewall panels extending at an angle with respect to one another. A lid is covering the open top of the bin, the lid having a discharge opening therethrough adjacent one side edge thereof. A fluid-containing bag is supported in the bin. A discharge valve is on an upper end of the bag, the discharge valve is positioned to extend through the discharge opening.

Valve support means in an upper end of the bin for supporting and holding the discharge valve in position to extend through the discharge opening, the valve support means having a valve support opening therethrough with an elongate generally keyhole shape that is wide at one end and narrow at the other end. The narrow end is aligned with the discharge opening through the lid. The discharge valve is received through the narrow end of the valve support opening, and locking means engaged with the discharge valve to hold it in the narrow end of the valve support opening. A liner insert is in the container, the liner insert is fitting closely in the bin sidewall and is extending from the bin closed bottom to the bin open top, the bag is confined within the liner insert.

The liner insert is substantially coextensive in height with the bin sidewall and extends at the upper end thereof to the open top of the bin. The valve support means comprises transverse means extending across an upper end of the liner insert, the transverse means includes a valve support tray attached to the upper end of the liner insert. The locking means comprises a substantially flat, disc-shaped locking pad on top of the tray, the locking pad having an opening therethrough in aligned registry with the narrow end of the valve support opening, an edge of the opening through the locking pad engaging a side of the discharge valve to hold it in position in aligned registry with the discharge opening through the lid.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAIL DESCRIPTION OF THE INVENTION

Figure 1:
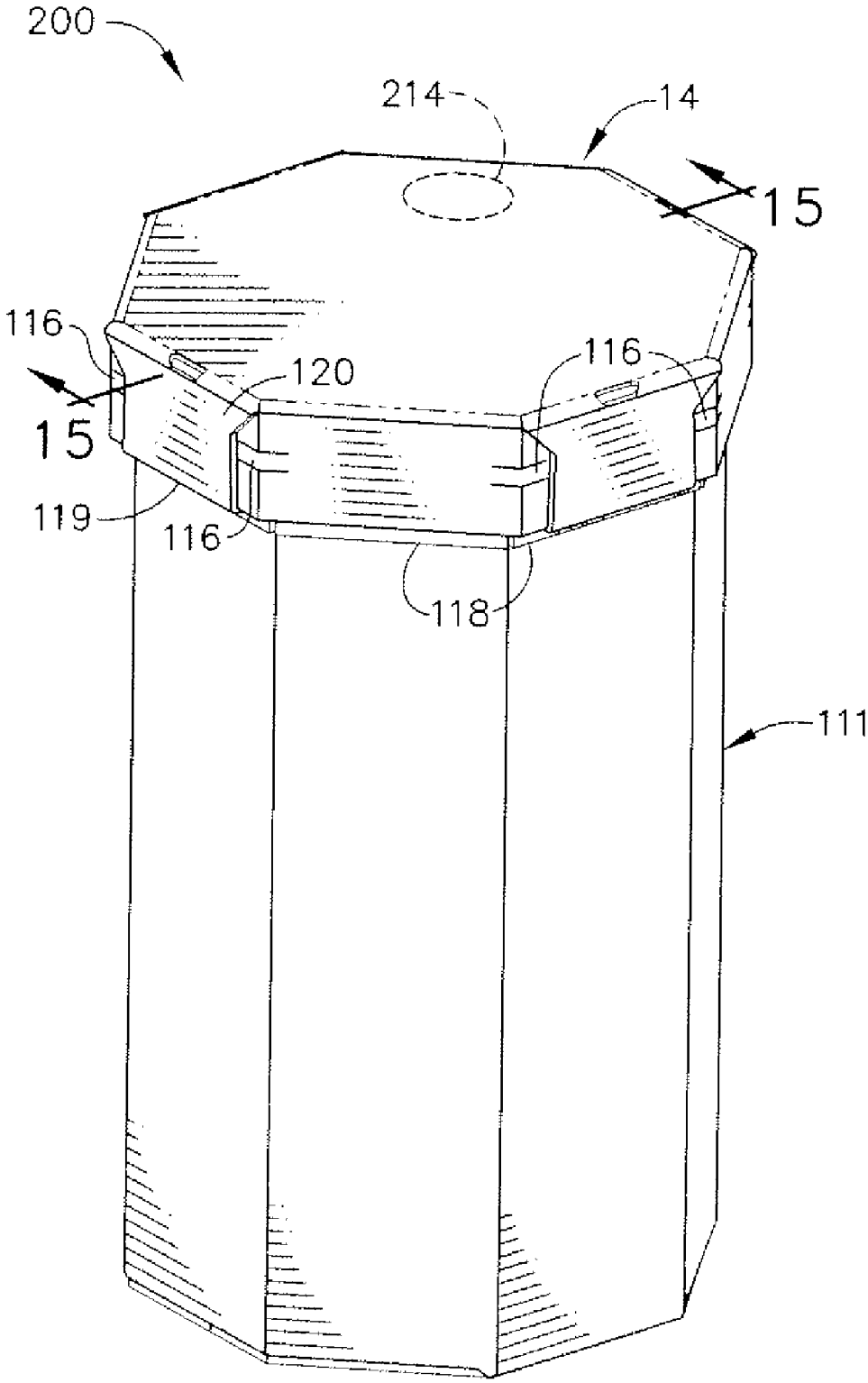
FIG. 1 is a top perspective view of a container according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
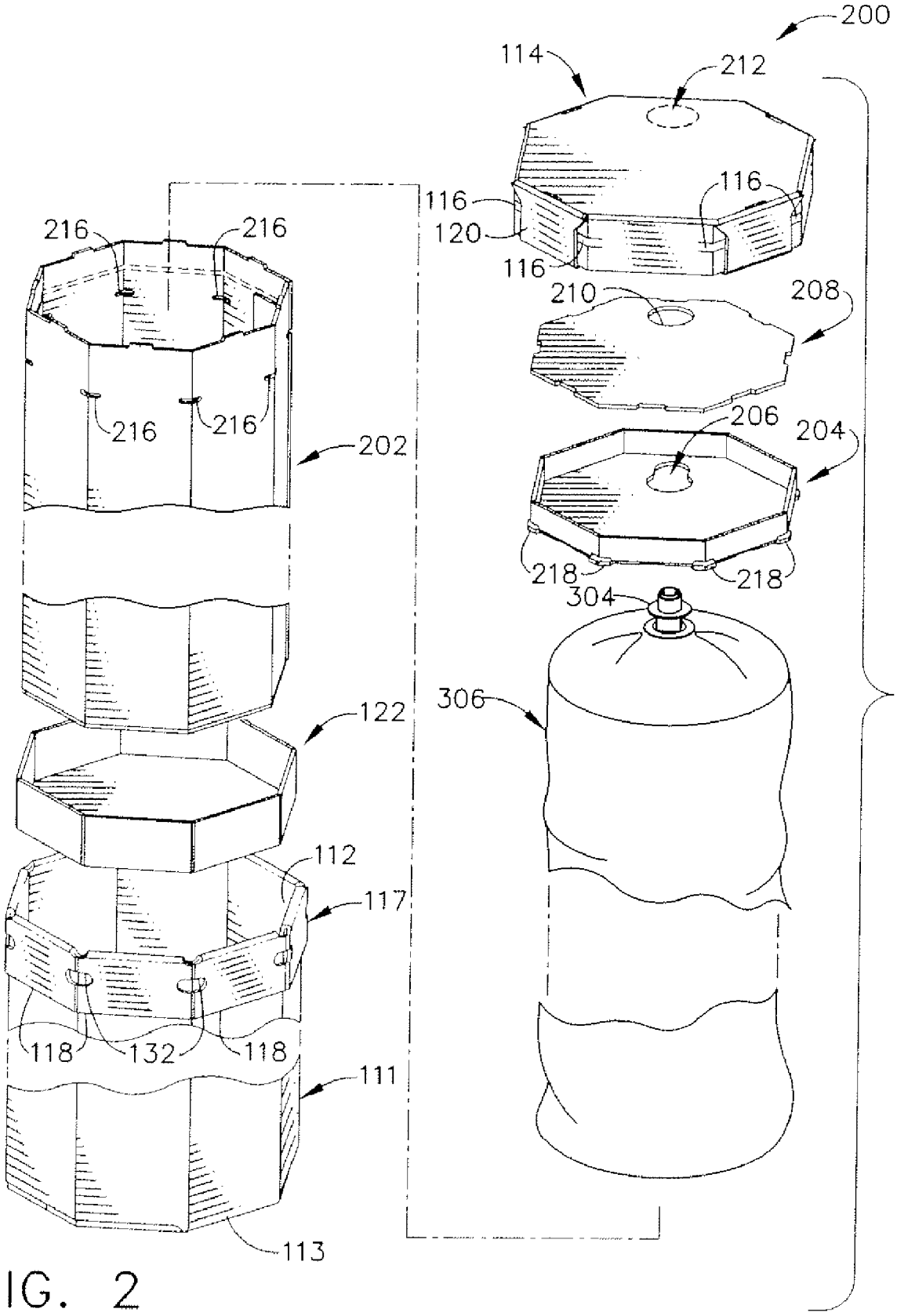
FIG. 2 is an exploded perspective view of the bin, tray, liner and lid according to a preferred form of the invention.
Figure 3:
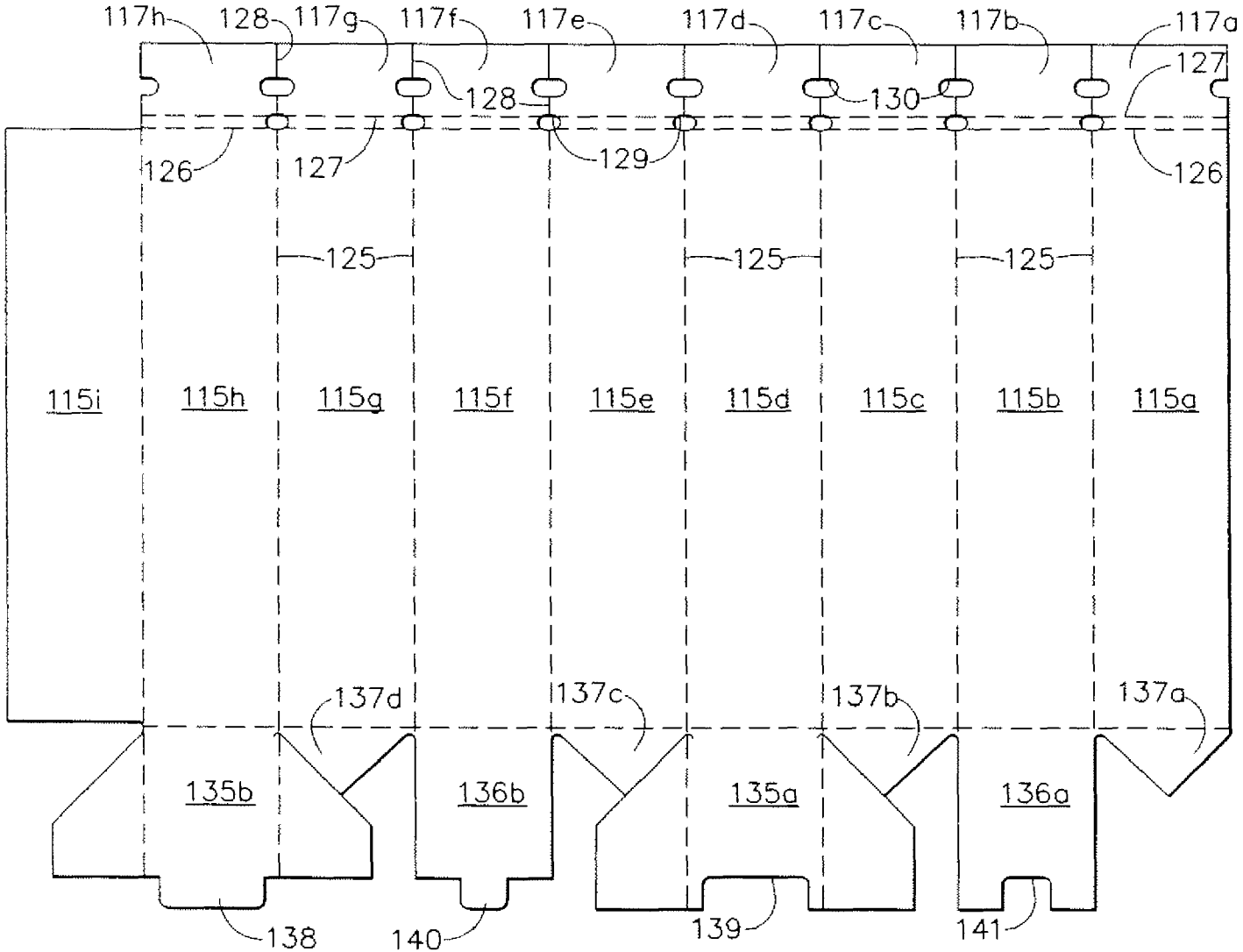
FIG. 3 is a plan view of a blank B1 for making the bin according to a preferred embodiment of the invention.
Figure 28:
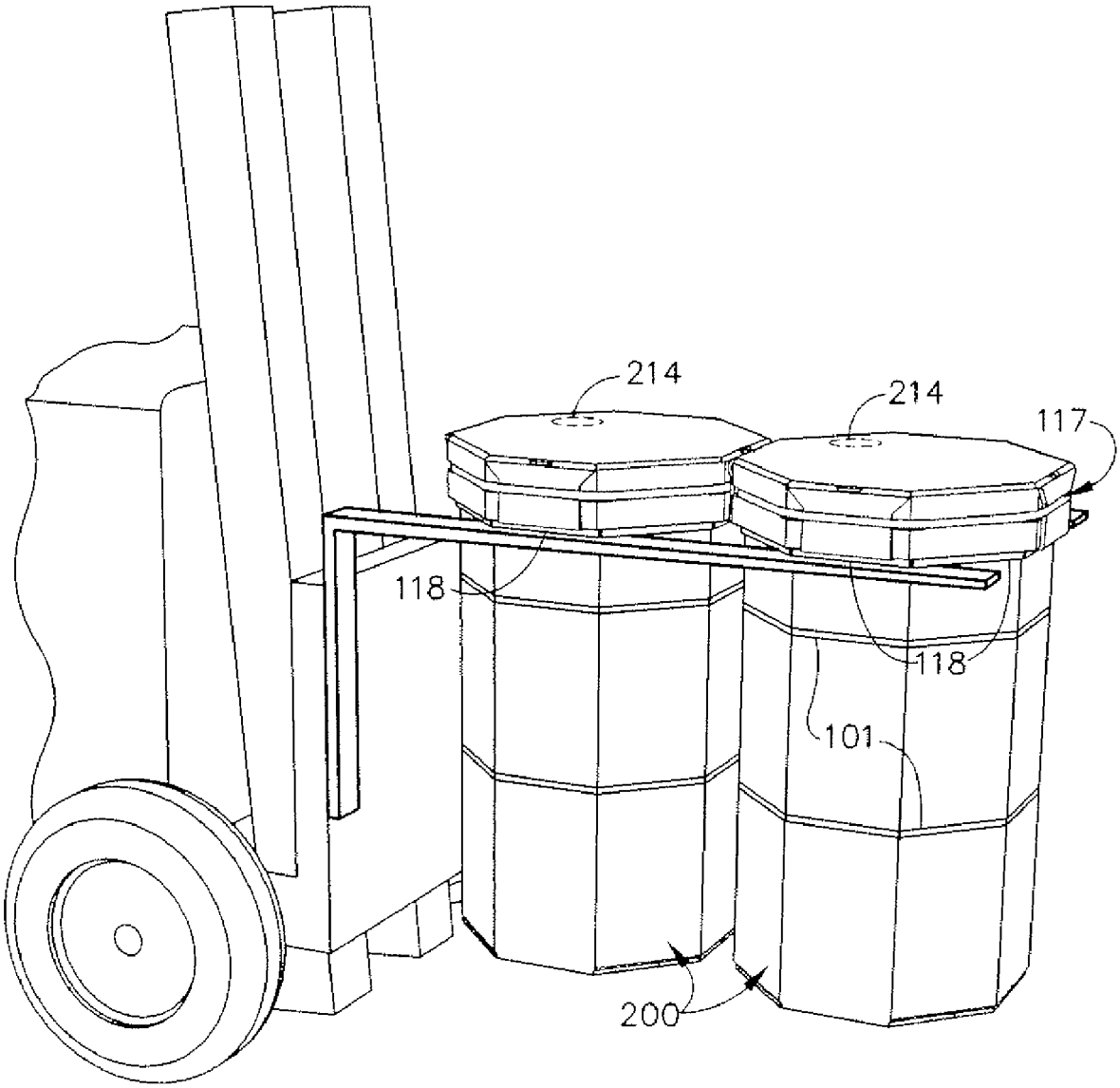
FIG. 28 depicts containers according to the invention being lifted to an elevated position by a forklift.

A container 200 according to the invention is indicated generally in FIGS. 1 and 2. The container 200 includes a bag (FIGS. 46 & 50) for storing and transporting liquid therein. A discharge valve (e.g., FIG. 47) is attached to the bag for transferring liquid into and/or out of the bag. The container 200 comprises a bin or case 111 with an open top 112, a closed bottom 113, and a cover or lid 114 closing the open top 112. The cover or lid 114 includes a recess 212 defined by perforation line 214 which is punched out to expose a discharge valve (FIG. 46) as will be described in greater detail in hereinbelow. In a preferred embodiment, the bin 111 is octagonal and has eight sidewall panels 115*a*-115*h*. As described in more detail hereinafter, a locking feature 116 is provided on the lid and the bin 111 to lock the lid 114 to the bin if desired. As seen best in FIG. 2, a rim 117 extends around the upper end of the bin 111 and presents a downwardly facing shoulder 118. The rim 117 comprises a series of short straight sections 17*a*-17*h* each having a length substantially the same as the width of the associated sidewall panel, and as seen in FIG. 1, the width of the rim 117 is such that the shoulder is spaced slightly below the bottom edge 119 of the cover sidewall 120. This enables the tines of a forklift to engage the rim 117 to lift and carry the container 200, as depicted in FIG. 28.

With reference to FIG. 2, which shows a preferred embodiment, a tray insert 122 is placed in the bottom of the bin 111, and an open-ended sleeve or liner insert 202 is seated in the tray and extends substantially the full height of the bin 111. The tray insert 122 fits snugly in the sidewall of the bin 111, and the bottom end of the liner insert 202 fits snugly in the tray insert 122. The liner insert 202 includes a plurality of slots 216 used to support a valve support tray 204 via respective tray tabs 218. A locking pad 208 is used to securely hold the discharge valve in place. The valve support tray 204 and the locking pad 208 are used to support the discharge valve through openings 206, 210. The container 200 may be used without the tray insert 122 and liner insert 202, but their use ensures a leak-proof container, especially when liquids or semi-liquids are placed in it.

Figure 4:
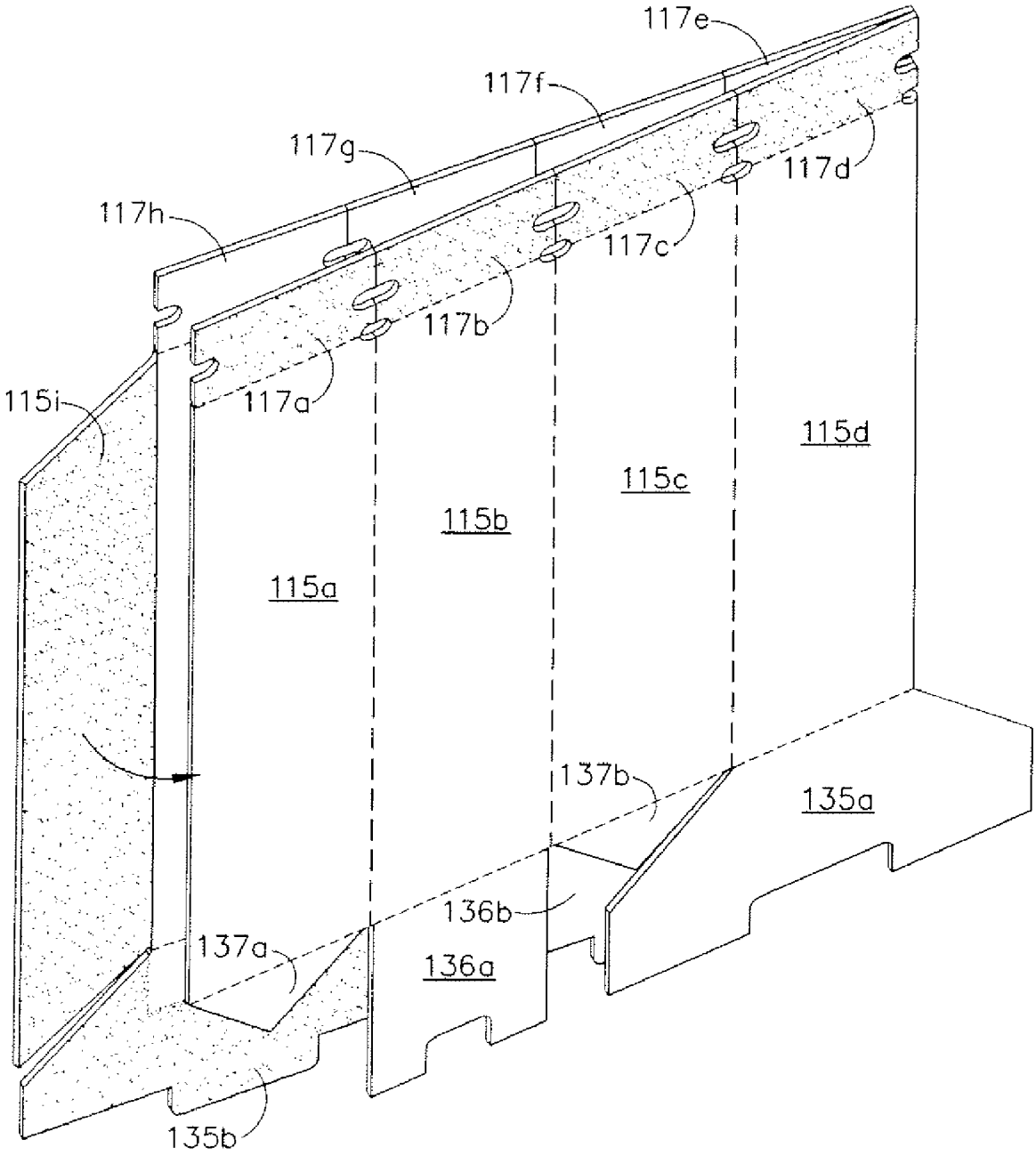
FIG. 4 is a perspective view showing the blank of FIG. 3 folded onto itself and depicting the glue panel in partially folded position.
Figure 9:
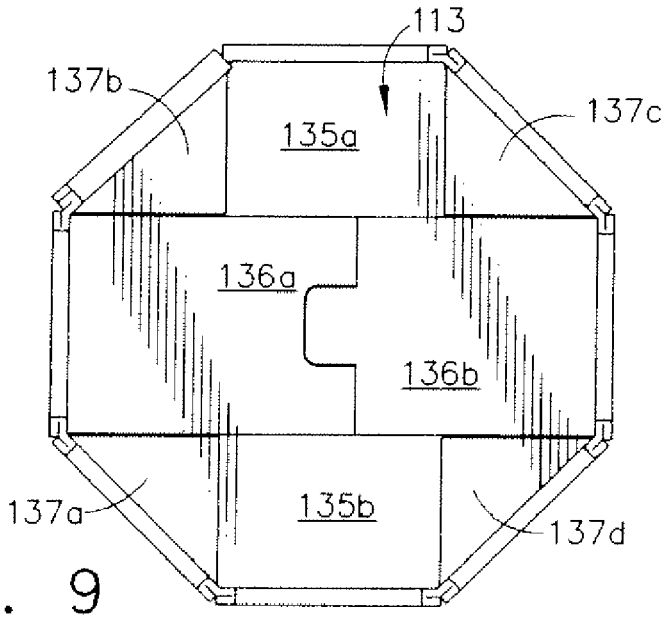
FIG. 9 is a plan view of the interior of the bottom of the bin, showing the relationship of the bottom flaps after they have been folded and secured to one another.
Figure 10:
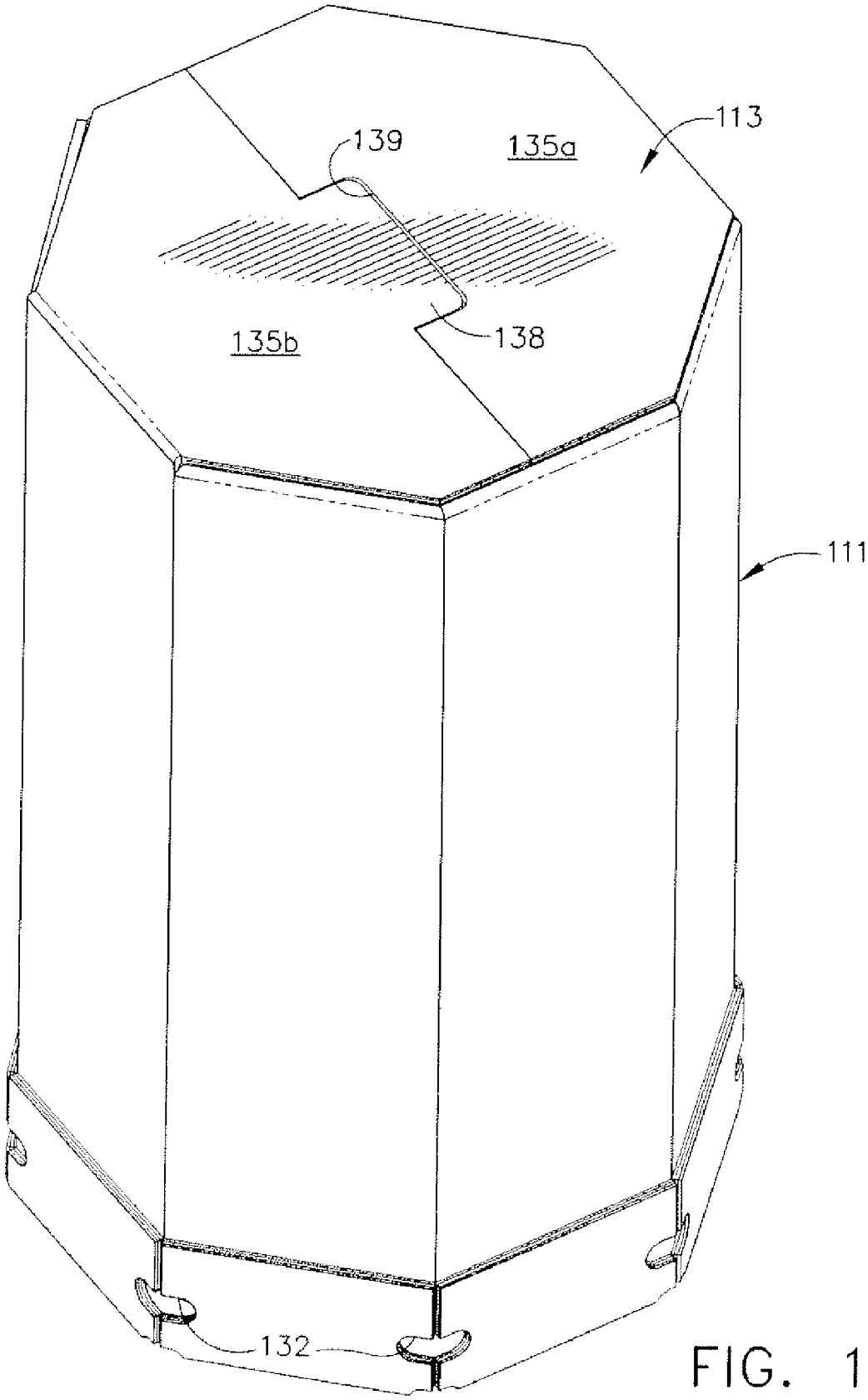
FIG. 10 is a fragmentary perspective view showing the flat smooth outer bottom of the bin when the bottom flaps are fully folded and secured together.
Figure 11:
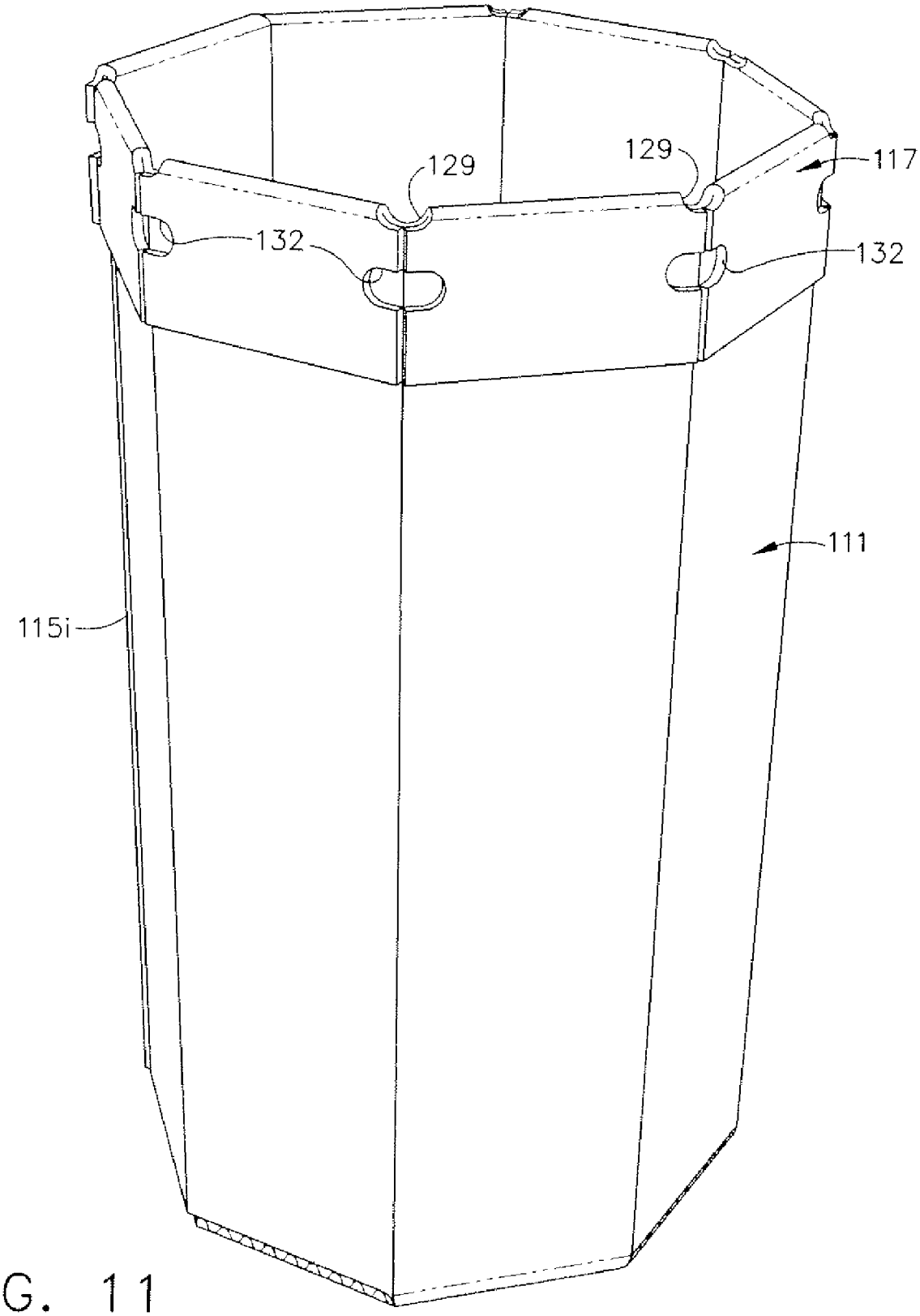
FIG. 11 is a top perspective view of a bin according to the preferred embodiment.

A blank B1 for making a preferred embodiment of the bin 111 of the invention is illustrated in FIGS. 3-10. The blank B1 has eight substantially identical elongate rectangular sidewall-forming panels 115*a*-115*h* joined together along spaced parallel fold scores 125, and a substantially identical panel 115*i* at one end of the blank forming a glue panel. When the blank B1 is folded onto itself to form the bin 111, as shown in FIG. 4, the glue panel 115*i* overlaps and is glued to wall-forming panel 115*a*. Rim-forming flaps 117*a*-117*h* are foldably joined to one end of the respective panels 115*a*-115*h* along a double fold score 126, 127, and are separated from one another by cuts 128. The area between the scores 126, 127 is crushed and a series of small stress relieving cutouts 129 are made at the base of the cuts 128 and between the scores 126, 127, extending slightly into the ends of scores 125 to prevent tearing of the material when the flaps are folded 180 degrees to lie against the outer surface of the side panels as seen in FIGS. 2 and 5-7. A series of second cutouts 130 are made in the flaps 17*a*-17*h*, extending across approximately the midpoint of the cuts 28, defining recessed areas or notches 132 extending across each corner of the rim 117 in a container erected from the blank, as seen in FIGS. 2 and 11. These notches 132 define part of the lid locking structure mentioned previously.

Figure 8:
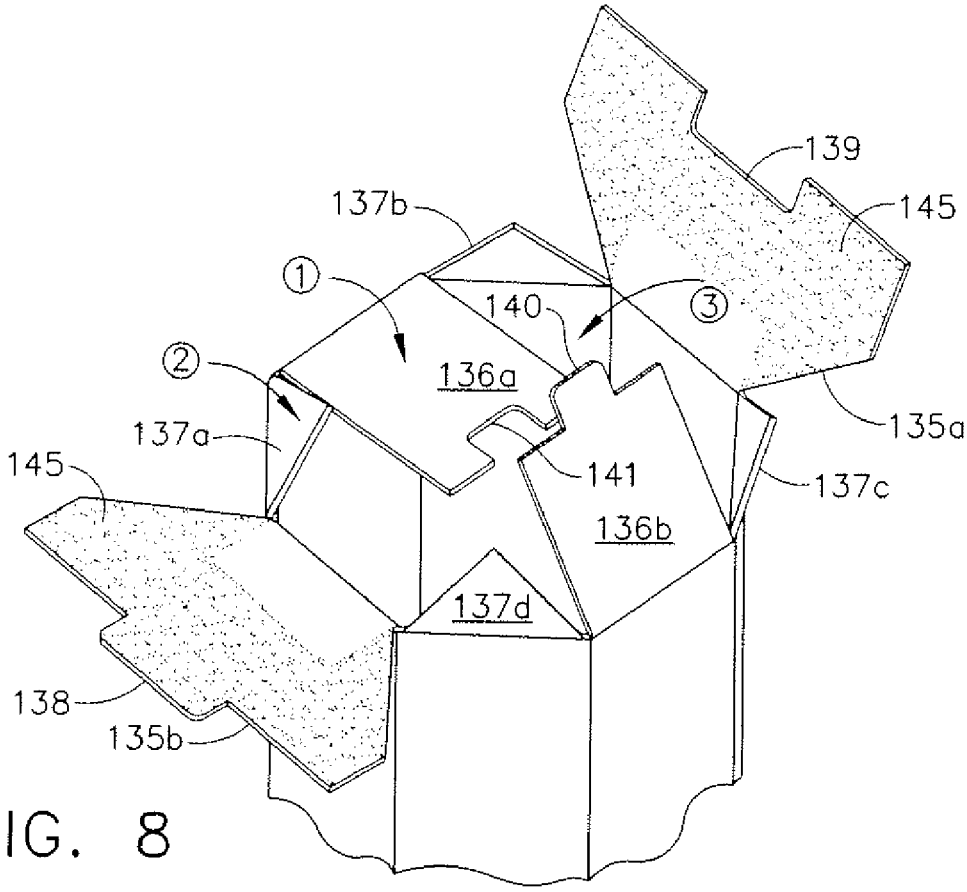
FIG. 8 is a fragmentary perspective view of the bottom end of the bin, showing the bottom flaps being folded into operative position.

Bottom-forming flaps are foldably joined along the edge of the blank B1 opposite the rim-forming flaps 117*a*-117*h*, and include a pair of generally trapezoidally shaped major bottom flaps 135*a* and 135*b* that are disposed in opposed relationship to one another when the bin 111 is erected from the blank, a pair of rectangularly shaped minor bottom flaps 136*a* and 136*b* that are in opposed relationship to one another and disposed orthogonally to the flaps 135*a* and 135*b* when the bin 111 is erected, and intermediate triangularly shaped flaps 137*a*-137*d* attached to the side panels located between the side panels carrying the major and minor flaps. The outer end edge of one of the major bottom flaps 135*a* and 135*b* has an outwardly projecting tab 138 and the outer end edge of the opposite major bottom flap has a complemental notch 139. Similarly, the outer end edge of one of the minor bottom flaps has an outwardly projecting tab 140 and the outer end edge of the opposite minor bottom flap has a complemental notch 141. These tabs 138, 140 and notches 139, 141 serve as an aligning feature when the bin 111 is being set up from its knocked-down of folded flat condition, as depicted in FIGS. 8-10.

Figure 5:
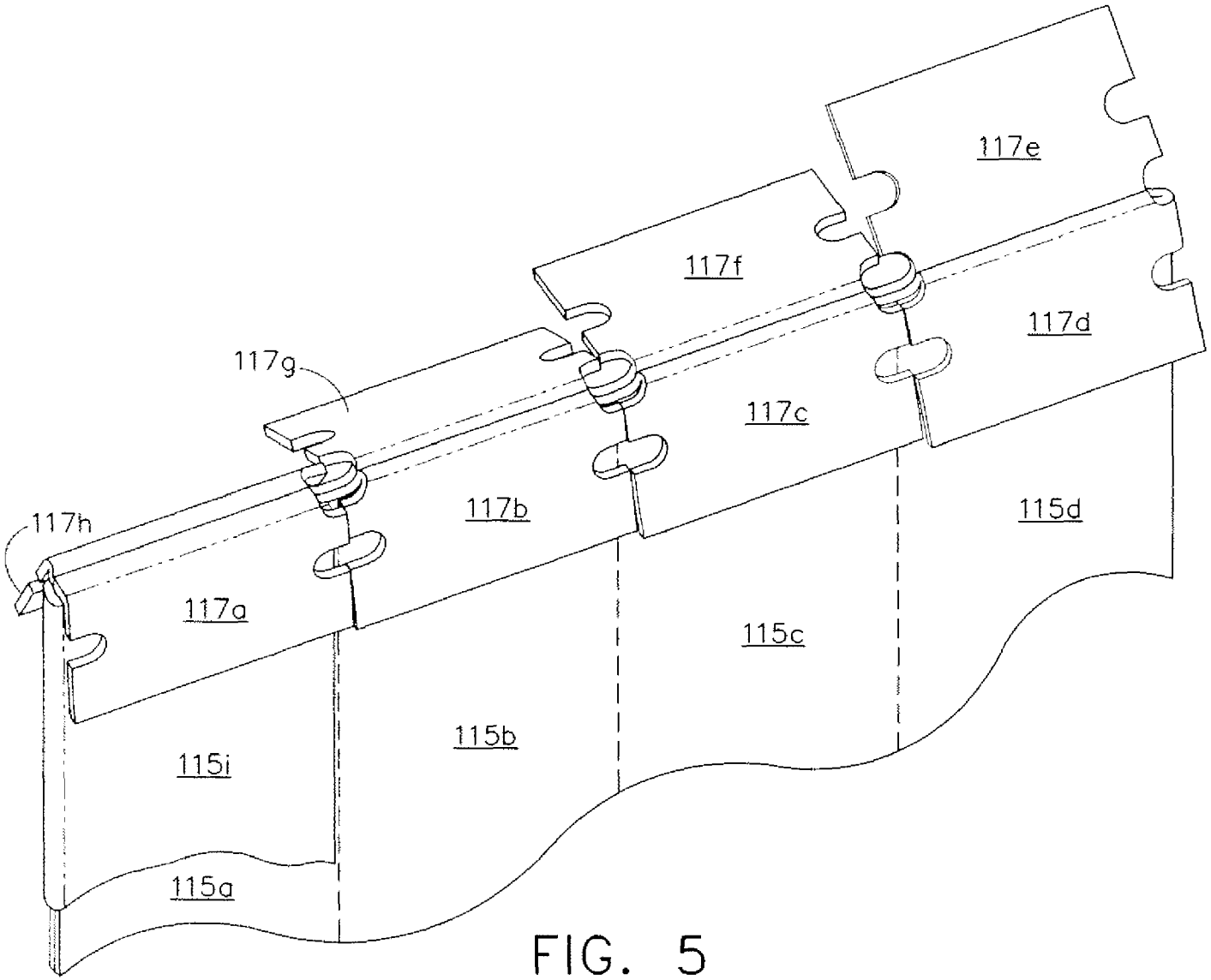
FIG. 5 is a fragmentary perspective view of the blank of FIG. 3 showing the glue panel in glued position and depicting the top flanges being folded and secured to the sidewall to form the rim at the top of the container.
Figure 6:
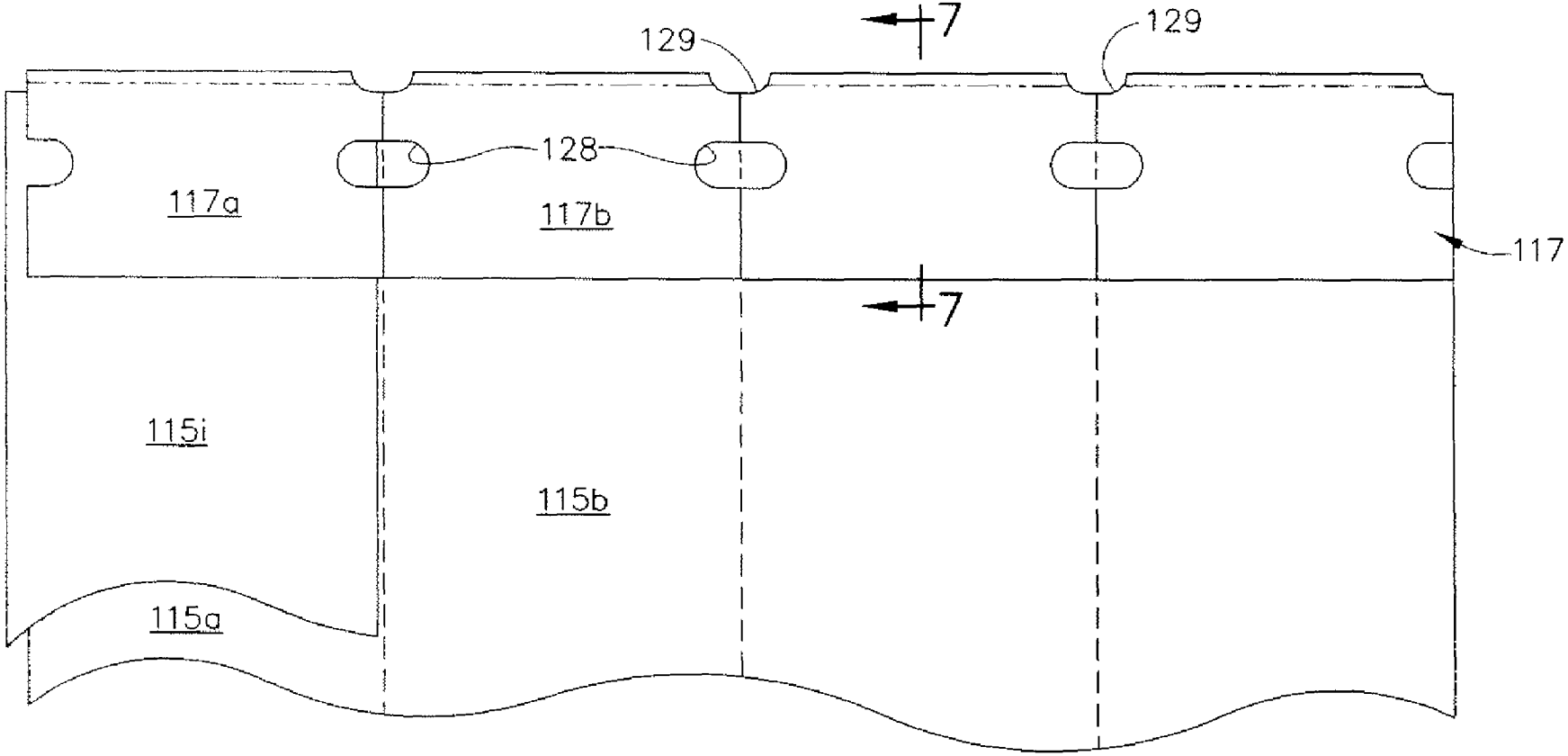
FIG. 6 is a fragmentary side view in elevation of the blank of FIG. 4, with the top flaps folded against and secured to the sidewall.
Figure 7:
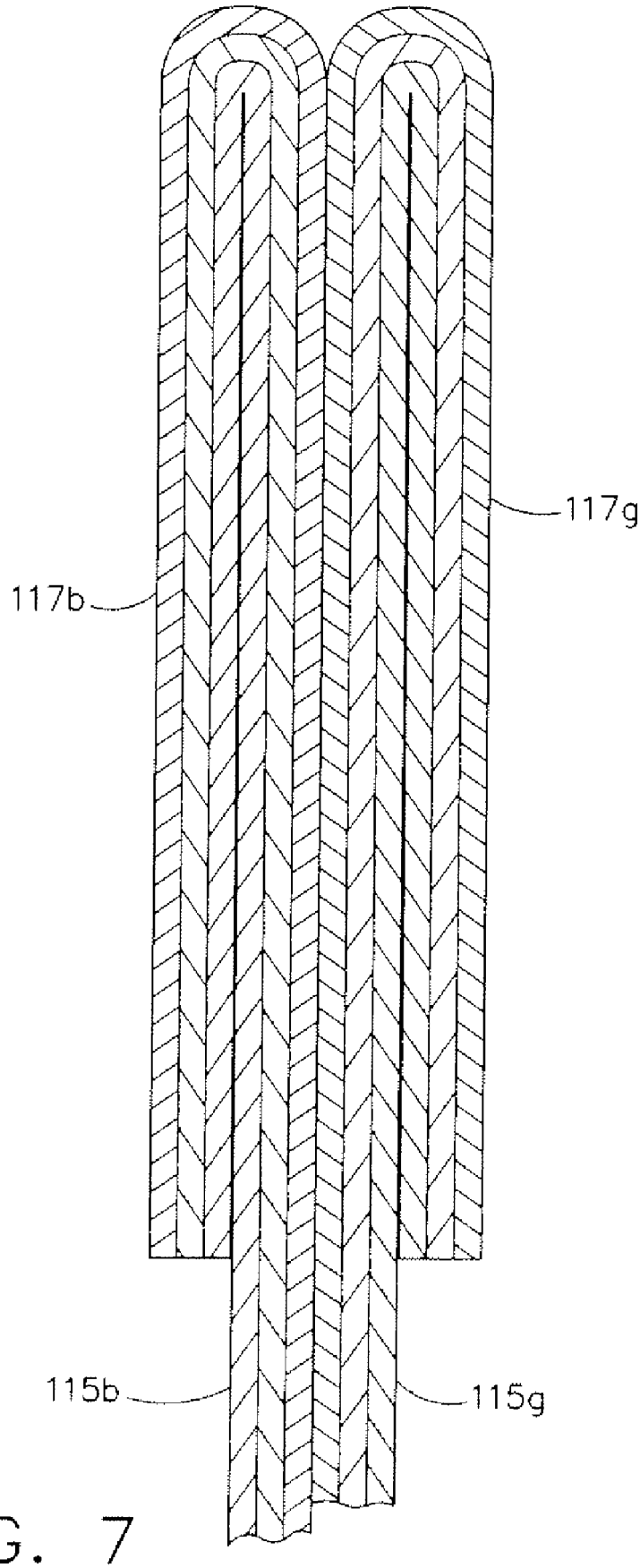
FIG. 7 is a fragmentary sectional view taken along line 7-7 in FIG. 6.

To erect the bin from the blank B1, the blank is folded in half and the glue panel 115*i* is adhesively attached in overlapping relationship to sidewall panel 115*a* as depicted in FIG. 4. The rim-forming flaps 117*a*-117*h* are then folded through 180° and secured to the upper outer surface of the respective sidewall panels 115*a*-115*h* as depicted in FIGS. 5-7. The flaps 117*a*-117*h* preferably are secured to the sidewall panels with an adhesive, but other means of attaching the flaps to the sidewalls may be used if desired and/or appropriate. The bin 111 is then opened up into a tubular configuration as shown in FIG. 8, and the minor bottom flaps 136*a* and 136*b* are folded inwardly, followed by inward folding of the intermediate flaps 137*a*-137*d*, and then followed by inward folding of the major bottom flaps 135*a* and 135*b*. When the flaps are all folded inwardly over the bottom of the bin 111, the major bottom flaps 135*a* and 135*h* completely overlap both the minor bottom flaps and the intermediate bottom flaps, and as indicated by the shaded areas in FIG. 8, adhesive 45 is applied to the major bottom flaps over the entire area where they overlap the other bottom flaps. The tabs 138, 140 and notches 139, 141 on the ends of the major and minor bottom flaps serve to align the flaps into proper relationship with one another and to square up the bin 111. Further, the size and shape of the bottom-forming flaps produces a flat smooth surface on both the interior and exterior of the bin, as depicted in FIGS. 9 and 10, wherein FIG. 9 is a plan view of the interior surface of the bottom and FIG. 10 is a perspective view of the outer surface. FIG. 11 is a top perspective view of a fully erected bin 111 in accordance with the invention.

Figure 12:
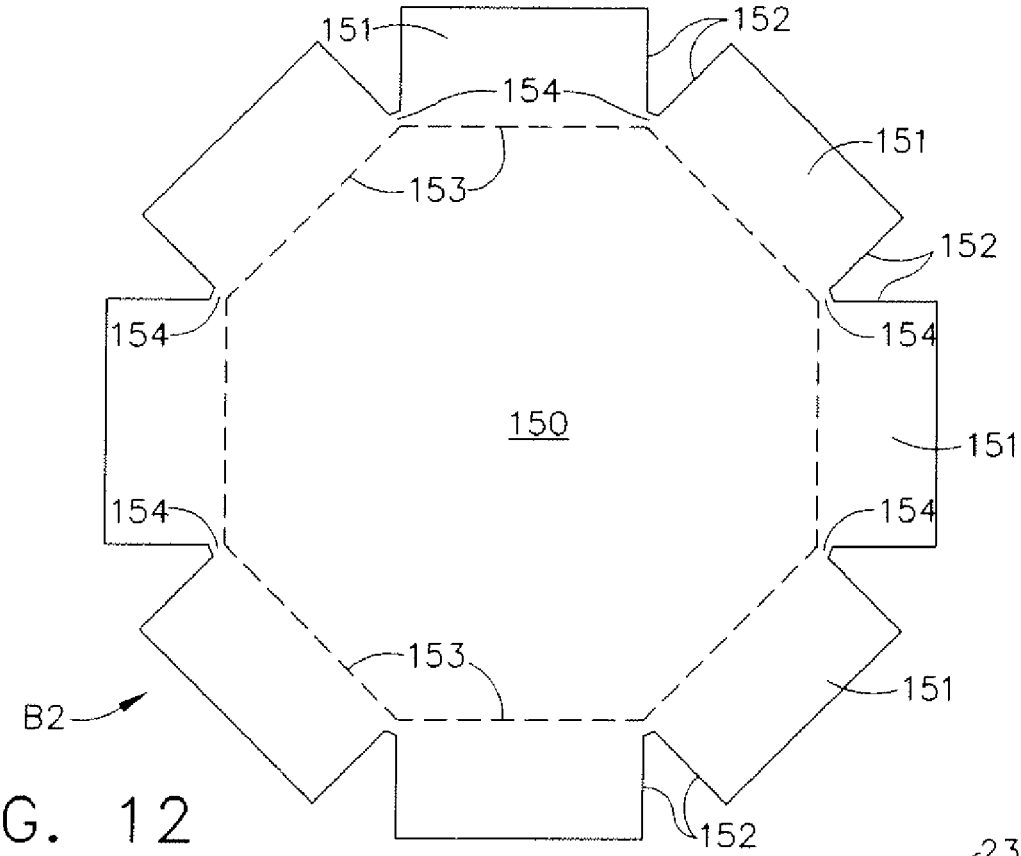
FIG. 12 is a plan view of a blank for making a tray insert for a preferred embodiment of the invention.
Figure 13:
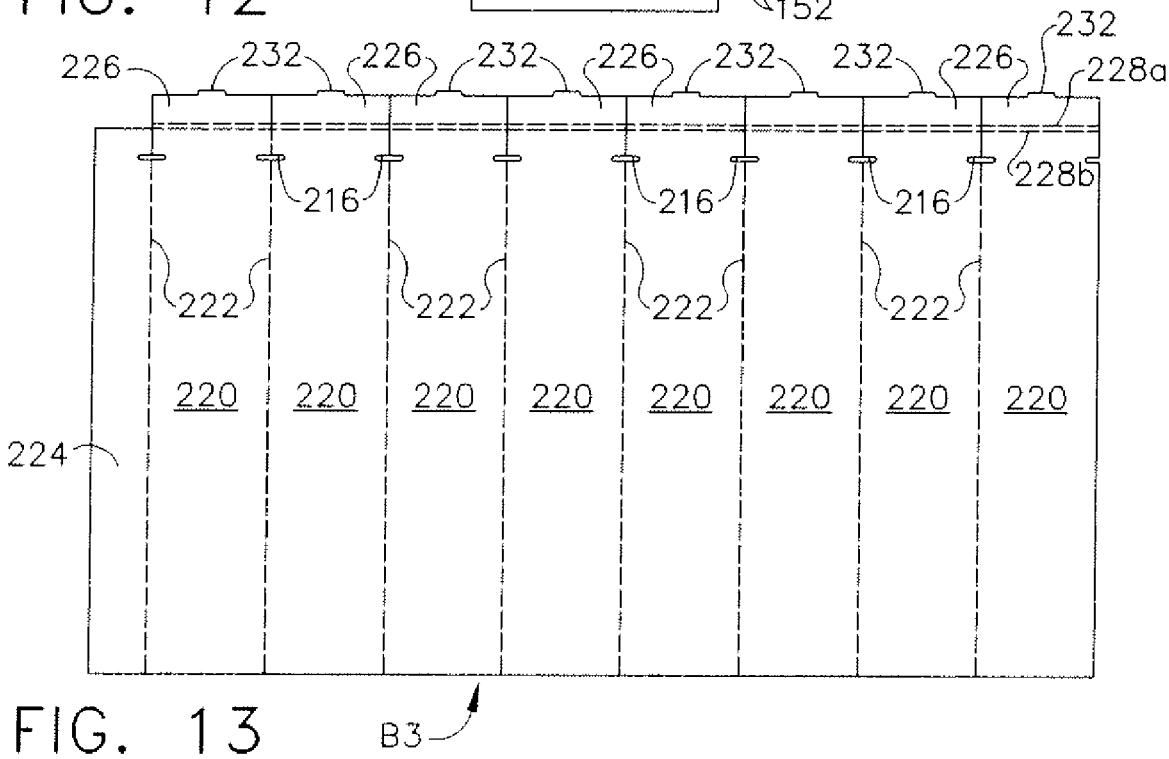
FIG. 13 is a plan view of a blank for making an open-ended liner insert for a preferred embodiment of the invention.

A blank B2 for making the optional but preferred tray insert 122 is shown in FIG. 12. The blank B2 comprises a central panel 150 shaped corresponding to the shape of the bin 111 octagonal in the example shown—and flaps 151 extending from each straight edge of the central panel 150. The flaps 151 are separated from one another by cutouts 152 that terminate a short distance from the fold line 153 joining the respective flaps to the central panel 150, leaving a small gusset 154 at the base of the cutout 152 on each side of the flaps 151. To erect the tray insert 122, the flaps 151 are simply folded upwardly as shown in FIG. 2.

Figure 14:
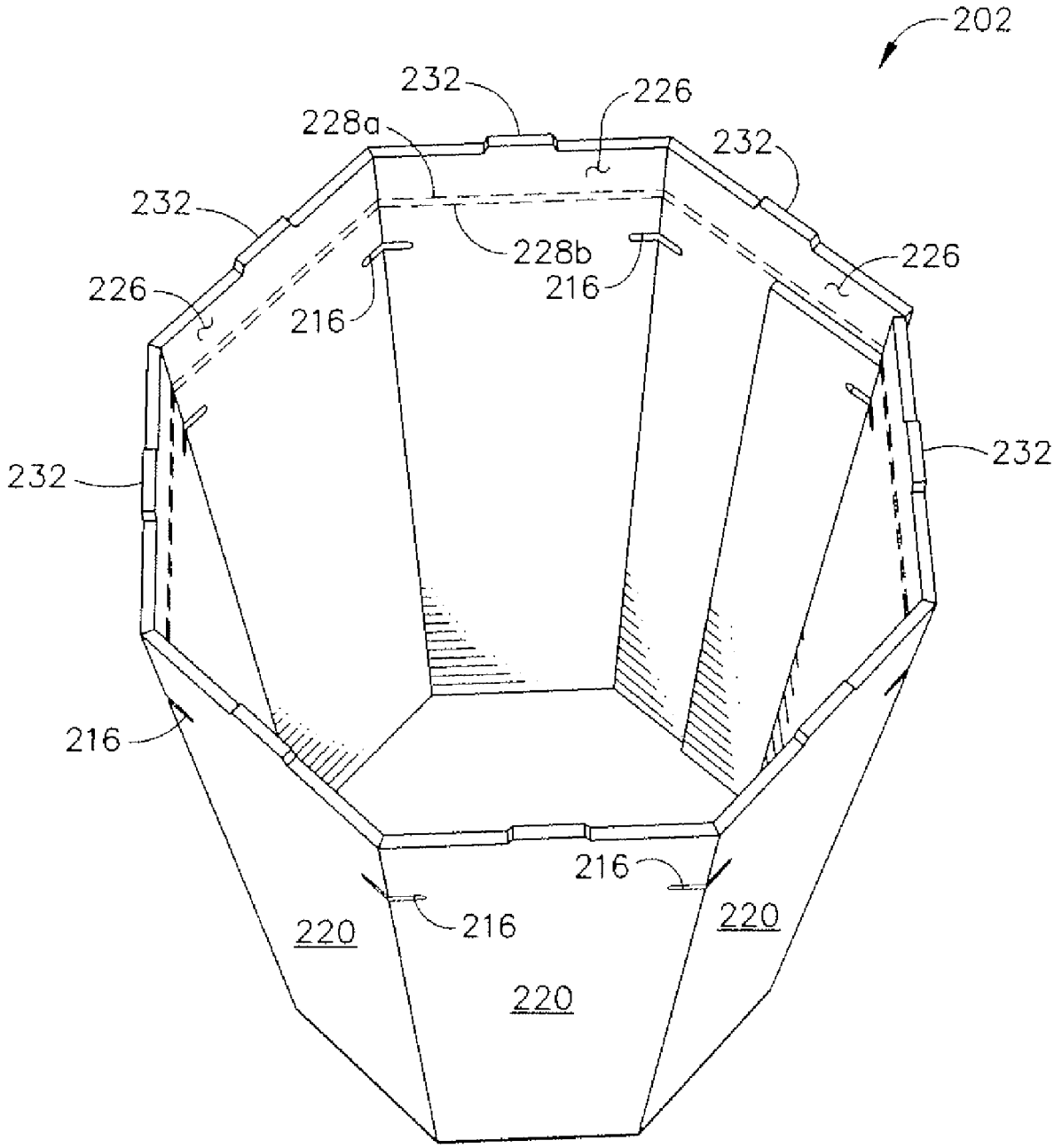
FIG. 14 is a perspective view showing a liner insert ready to be positioned in the bin.
Figure 22:
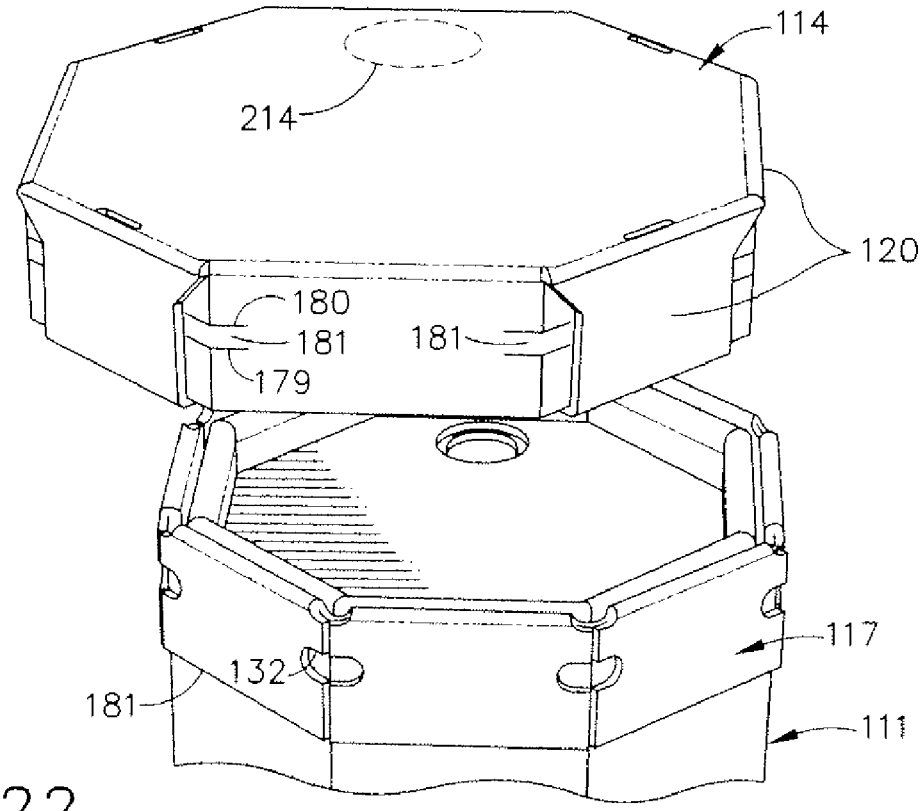
FIG. 22 shows the lid being positioned on the bin.
Figure 24:
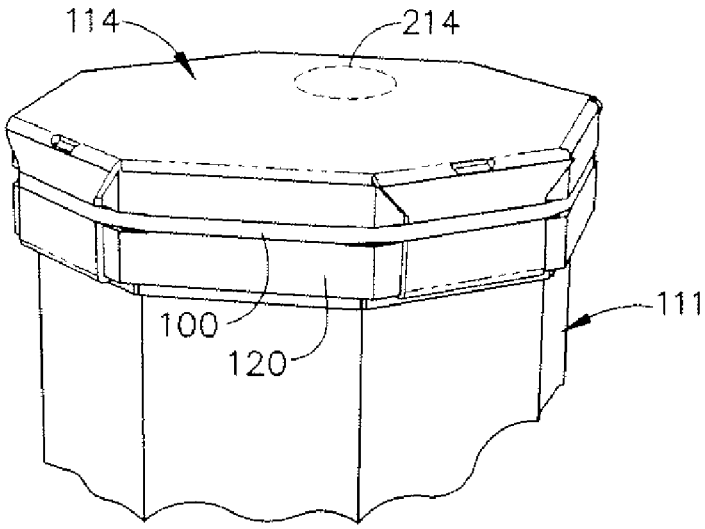
FIG. 24 is a fragmentary top perspective view of a container according to the invention, with a strap around the lid, reinforcing and securing it to the bin.

A blank B3 for making the liner insert 202 is shown in FIG. 14. The liner insert has a plurality of side panels 220 corresponding in number to the side panels of the bin 111, and a glue panel 224 at one end of the blank B3. In that form of the invention shown in FIGS. 22 and 36, the liner insert has a height the same as the height of the bin 111. However, one of ordinary skilled in art will appreciate that that the height of the liner insert 202 may be different from the height of the bin 111. Rim-forming flaps 226 are foldably joined to one end of the respective panels 224 along double fold lines 228*a*, 228*b*. Each of the Rim-forming flaps 226 includes a liner flange 232 formed on the longer side of the Rim-forming flaps 226 and extended outwardly. The liner flanges 232 fold over and lock into the valve support tray 204 as will be described in greater detail hereinafter. These flanges 232 are used to hold the liner insert 202 in place and preventing any leaks of product to the surrounding area. The liner insert 202 includes a plurality of slots 216 formed on the sidewalls 220. The plurality of slots 216 are formed in the upper section of the sidewall panels 220 near the double fold lines 228*a*, 228*b* extending across adjacent sidewall 220 in a manner that each of the fold lines 222 crosses the respective slots 216. The plurality of slots 216 are used to support the valve support tray 204 via respective tray tabs 218 as noted hereinabove with respect to FIG. 1 and will be described in greater detail hereinbelow. The flaps 226 are folded 180 degrees along the fold lines 228*a*, 228*b* to lie against the inner surface of the side panels 220. The liner insert 202 erected from the blank B3 is shown in FIG. 14.

In use, the tray insert 122 is placed in the open upper end of the bin 111 and the liner insert 123 positioned in the tray and pushed down into the bin 111 as shown in exploded view in FIG. 2.

Figure 16:
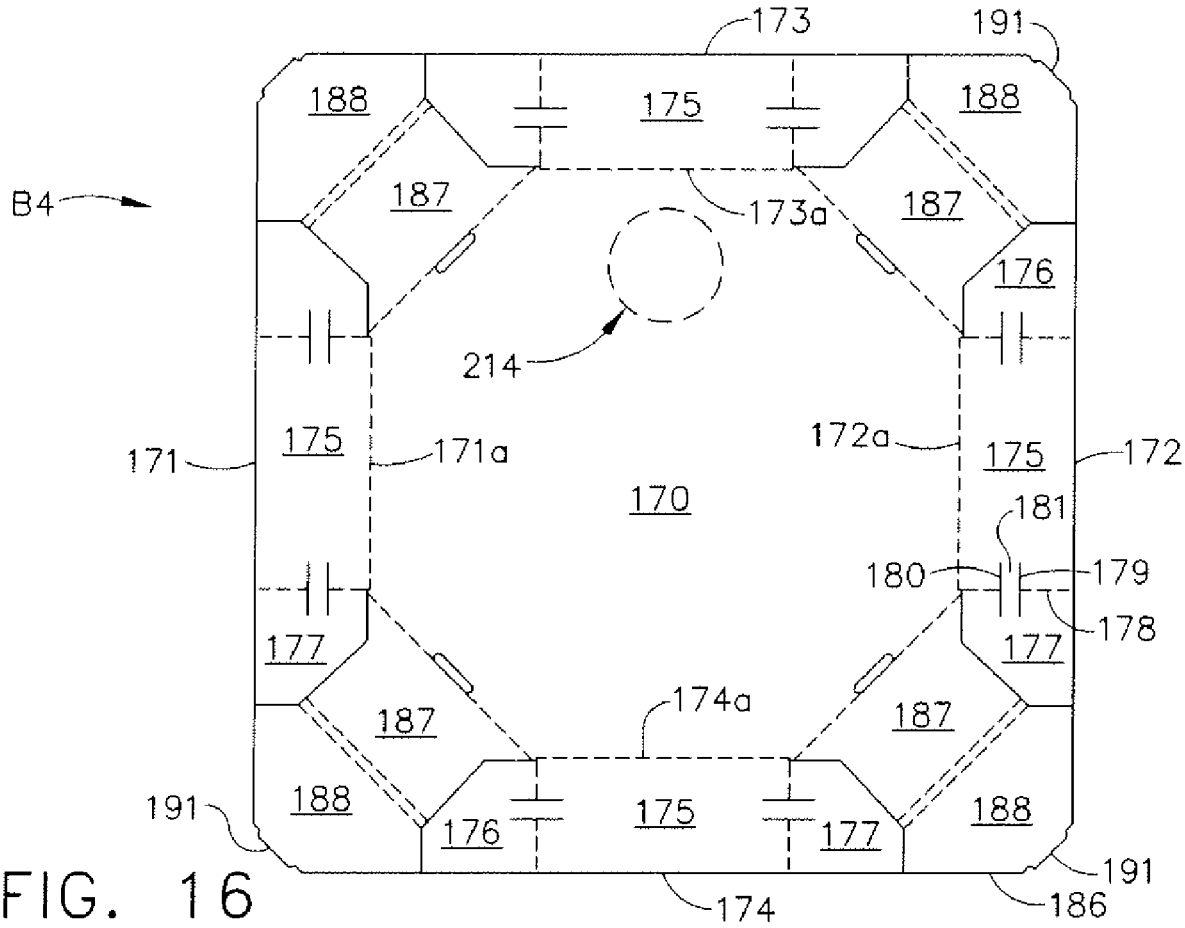
FIG. 16 a plan view of a blank for making a cover or lid according to a preferred embodiment of the drum of the invention.

A blank B4 for making the lid 114 is shown in FIG. 16. For the preferred octagonal shape of the container of the invention the blank B4 has an octagonal center panel 170 with a first pair of opposed side flaps 171, 172 foldably joined to respective opposite edges of the center panel 170 along opposed parallel fold scores 171*a*, 172*a*. A second pair of opposed side flaps 173, 174 is foldably joined to respective opposite edges of the center panel along fold scores 173*a*, 174*a* disposed orthogonally to the fold scores 171*a*, 172*a*. The side flaps 171, 172 and 173, 174 are identical to one another and each comprises a rectangular panel 175 equal in width to the adjacent edge of the center panel 170, with assembly flaps 176, 177 foldably joined to opposite ends thereof along fold scores 178. A pair of spaced parallel cuts 179 and 180 extend across each fold score 178 to define a bendable strip 181 between the cuts. A third pair of opposed side flaps 183, 184 is foldably joined to respective opposite edges of the center panel along fold scores 183*a*, 184*a* extending angularly between respective adjacent ends of the fold scores 171*a*, 174*a* and 172*a*, 173*a*. A fourth pair of opposed side flaps 185, 186 is foldably joined to respective opposite edges of the center panel along fold scores 185*a*, 186*a* extending angularly between respective adjacent ends of the fold scores 171*a*, 173*a* and 172*a*, 174*a*. The side flaps 183, 184 and 185, 186 are identical to one another and each comprises a first irregularly shaped panel 187 with inset side edges, and a second irregularly shaped panel 188 joined to the first panel along a double fold score 189. The first panel 187 forms an outer side panel and the second panel 188 forms an inner side panel in the lid 114 erected from the blank. A slot 190 is formed in the center panel 170 adjacent the midpoint of each of the fold scores 183*a*, 184*a*, 185*a* and 186*a*, and a tab 191 projects from the center of the outer end edge of each of the panels 188.

Figure 17:
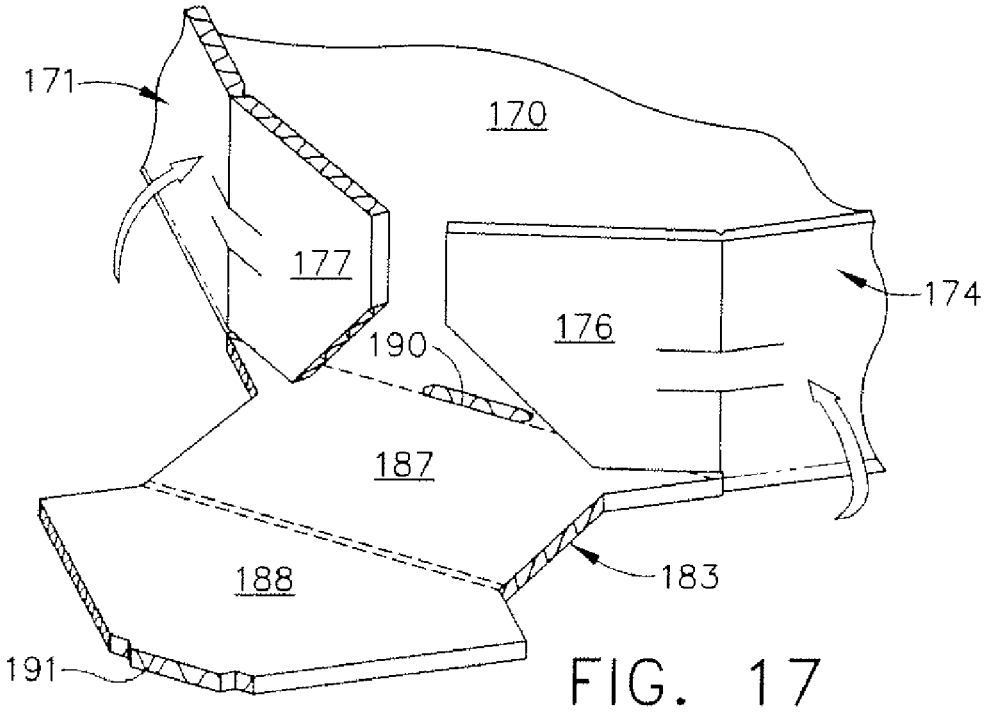
FIG. 17 is an enlarged fragmentary perspective view of a portion of the lid of FIG. 19, showing a first step in the sequence of folding the panels to make the lid.
Figure 18:
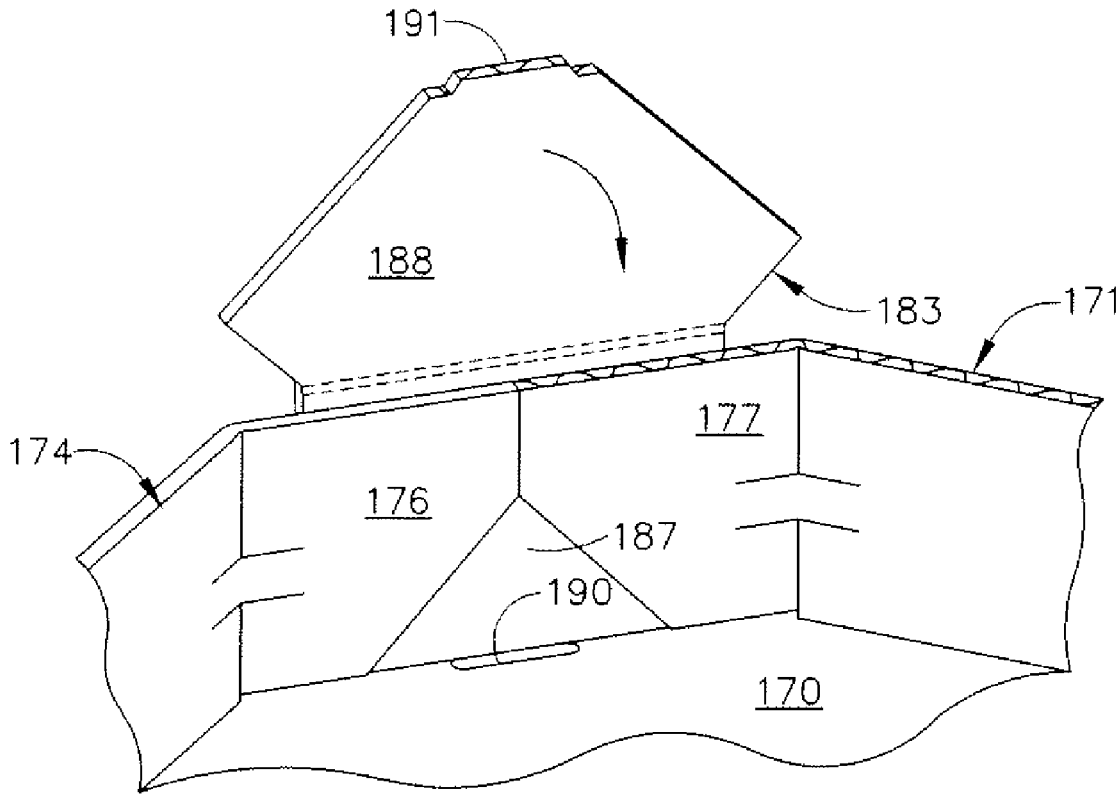
FIG. 18 is an enlarged fragmentary perspective view showing another step in folding the lid into operative condition.
Figure 19:
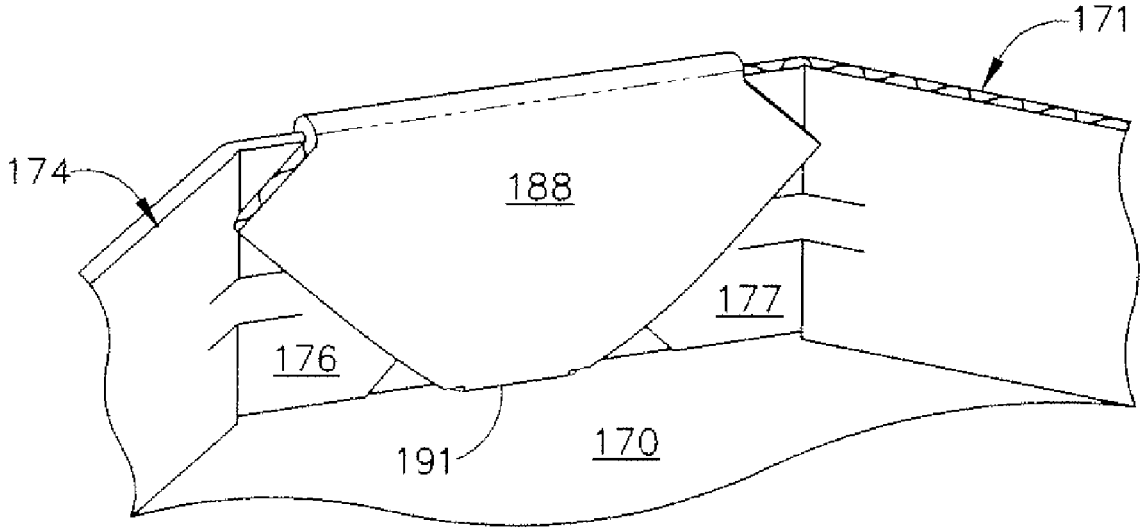
FIG. 19 is an enlarged fragmentary perspective view showing a portion of the lid in fully folded interlocked condition.
Figure 20:
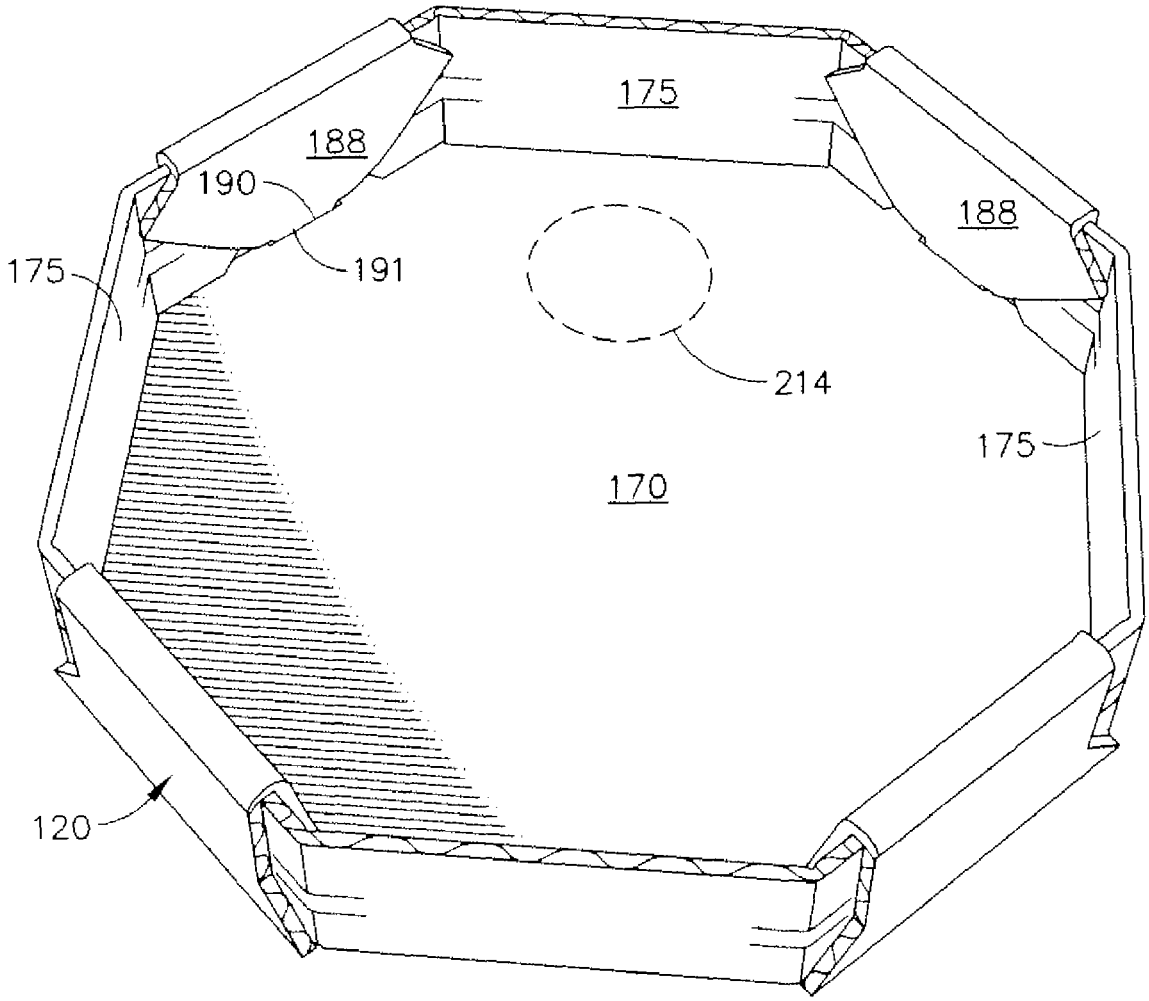
FIG. 20 is a perspective view looking at the underside of the lid in its fully folded erected condition.

The blank B4 is folded according to the sequence depicted in FIGS. 16-19 to form the lid 114, shown inverted in FIG. 20. The side flaps 171, 172, 173 and 174 are first folded upwardly, and the assembly flaps 176, 177 are folded inwardly, as depicted in FIG. 17. The side flaps 183, 184, 185 and 186 are then folded upwardly as shown in FIG. 18, and the panels 188 are folded inwardly and downwardly over the assembly flaps 176, 177 to engage the tabs 191 in slots 190 as shown in FIG. 19, holding the lid in erected condition as shown in FIG. 20. When the lid is placed on the container 10 as shown in FIGS. 1 and 18-20 the bendable strips 181 may be pushed inwardly to extend into the recessed areas or notches 132 on the corners of the bin to lock the lid 114 to the bin 111.

Figure 15:
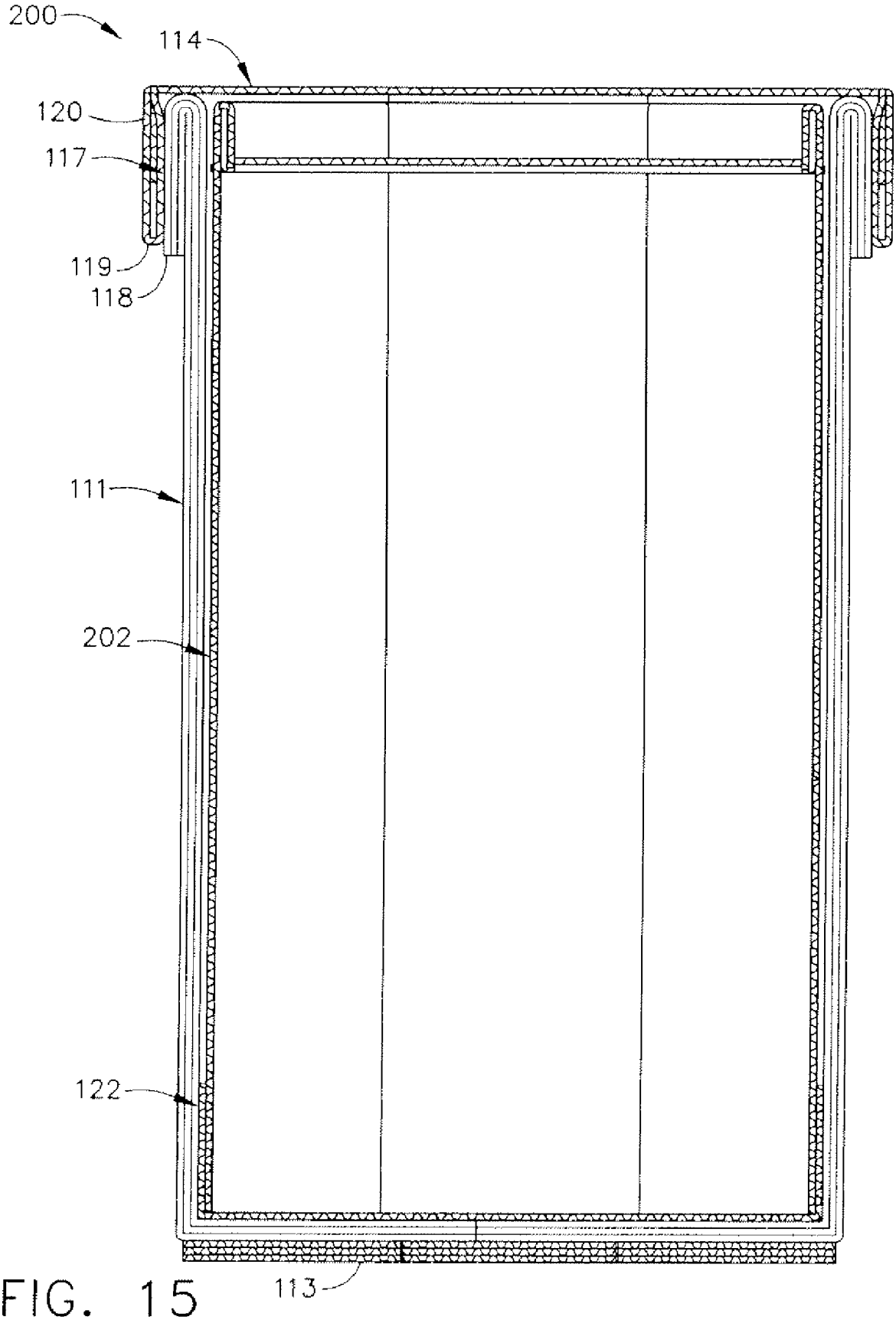
FIG. 15 is a longitudinal cross-sectional view of the container taken along line 15-15 in FIG. 1.
Figure 31:
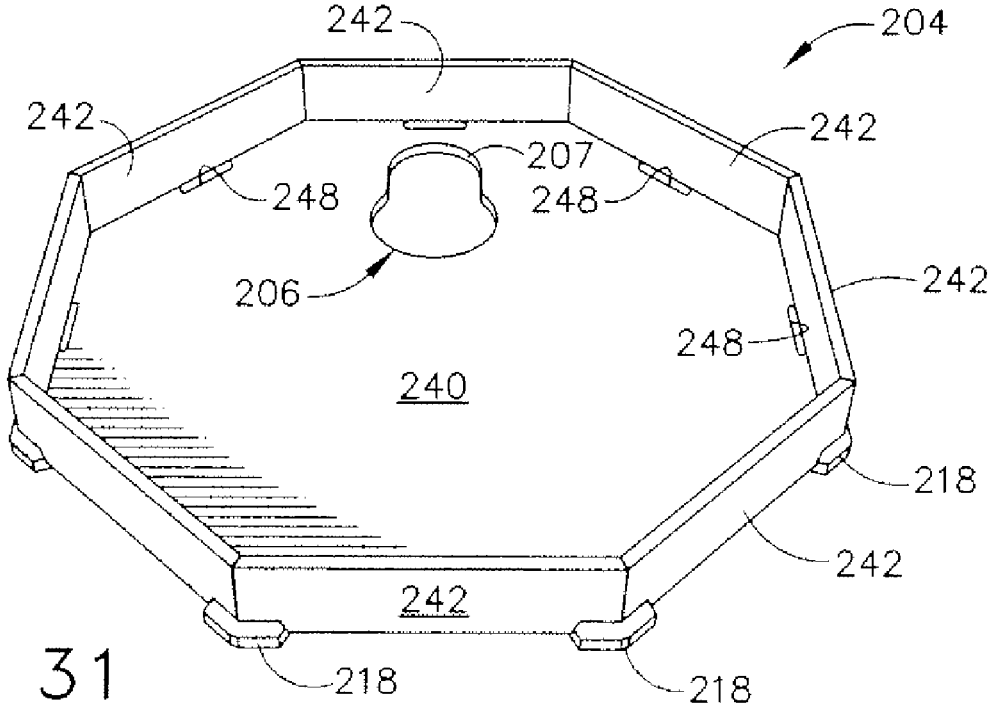
FIG. 31 is a perspective view of the fill valve support tray shown in FIG. 30 in its fully folded erected position.

Referring to FIG. 15 now, this depicts a longitudinal cross sectional view of the container 200 taken along line 15-15 in FIG. 1. It can be seen that the tray 122 is positioned in the bottom of the bin 111 and one end of the open-ended sleeve or liner insert 202 is seated in the tray 122. Moreover, the upper end of the liner insert 202 is aligned with the top edge of the bin 111. Although the height of the liner insert 202 and the height of the bin 111 are shown substantially the same, but depending on the configuration the height of the liner insert 202 can be shorter than the height of the bin 111. It should also be noted that the height of lid 114 is slightly shorter than the height of downwardly facing shoulder 118 of the rim 117 so that the tines of a forklift machine engages the rim 117 to lift and carry the container, as depicted in FIG. 31. In FIG. 15, the lid 114 is illustrated as single wall, but the lid can be double or triple wall, if desired. Likewise, the liner insert 202 is depicted as single wall, but the liner insert can be double or triple wall, if desired.

Figure 21:
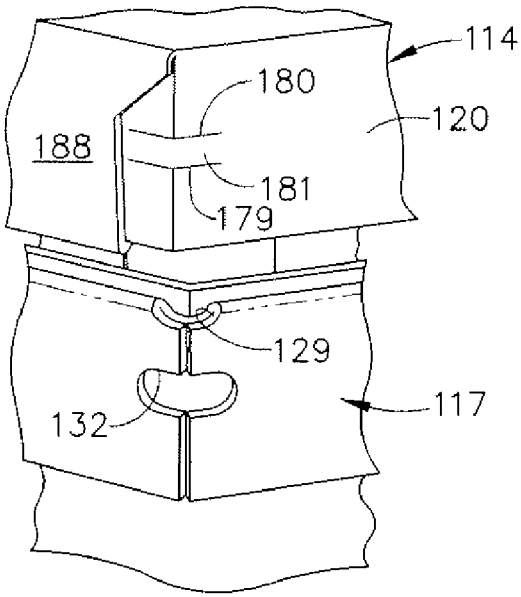
FIG. 21 is an enlarged fragmentary view in side elevation, showing a top portion of the drum and associated part of the lid with the structure that forms the interlock for locking the lid to the drum.
Figure 23:
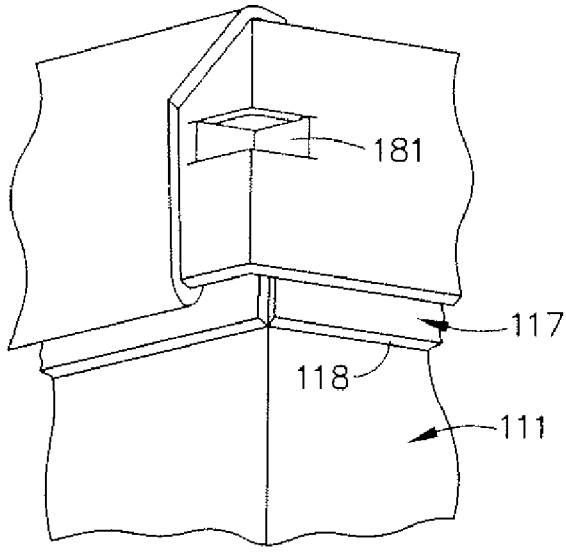
FIG. 23 shows the lid placed on the bin and the interlock structure engaged.

If desired, a strap or band 100 may be placed around the skirt of the lid 114, in the depressions left by pushing the strips 181 inwardly, as shown in FIG. 21. The strap presses the strips into the notches 132 in the corners of the bin 111 and firmly anchors the lid 114 to the bin. In addition to securing the lid 114 on the bin 111, the depressions serve as a guide for positioning the strap 100 and retaining it in position.

Figure 25:
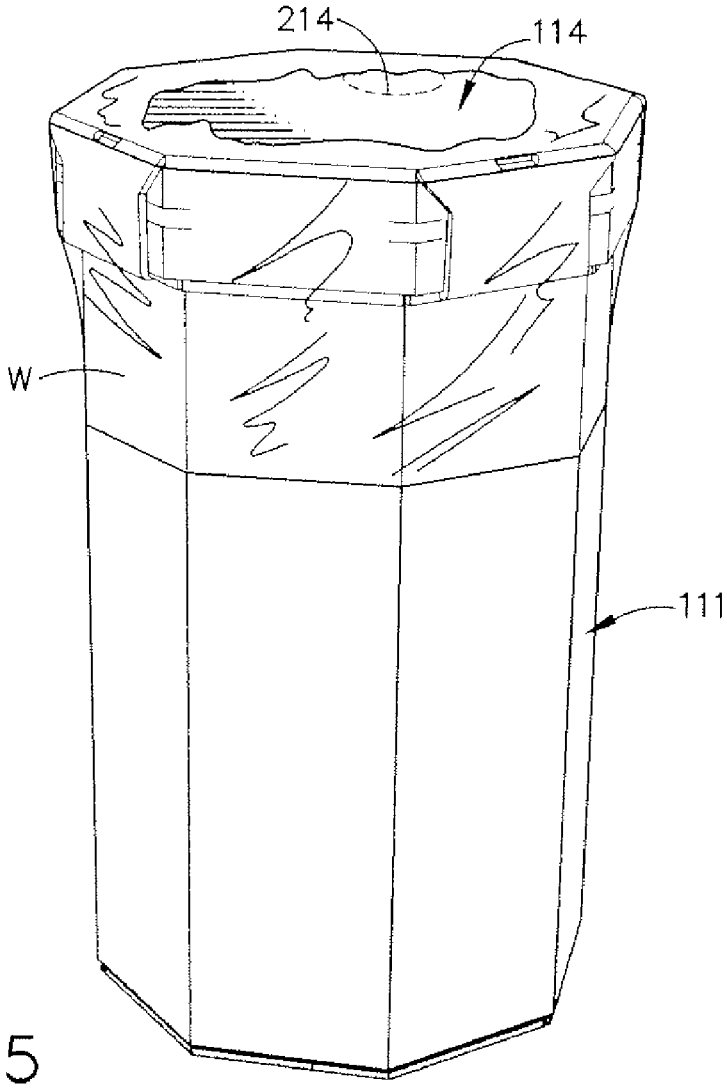
FIG. 25 is a top perspective view of a container according to the invention, with stretch film applied to the top of the container as an alternate means of securing the lid in position on the bin.

Alternatively, or in addition to the strap 100, stretch wrap or shrink wrap or the like W may be applied around the upper end of the container to help hold the lid 114 in place, as shown in FIG. 25.

Figure 26:
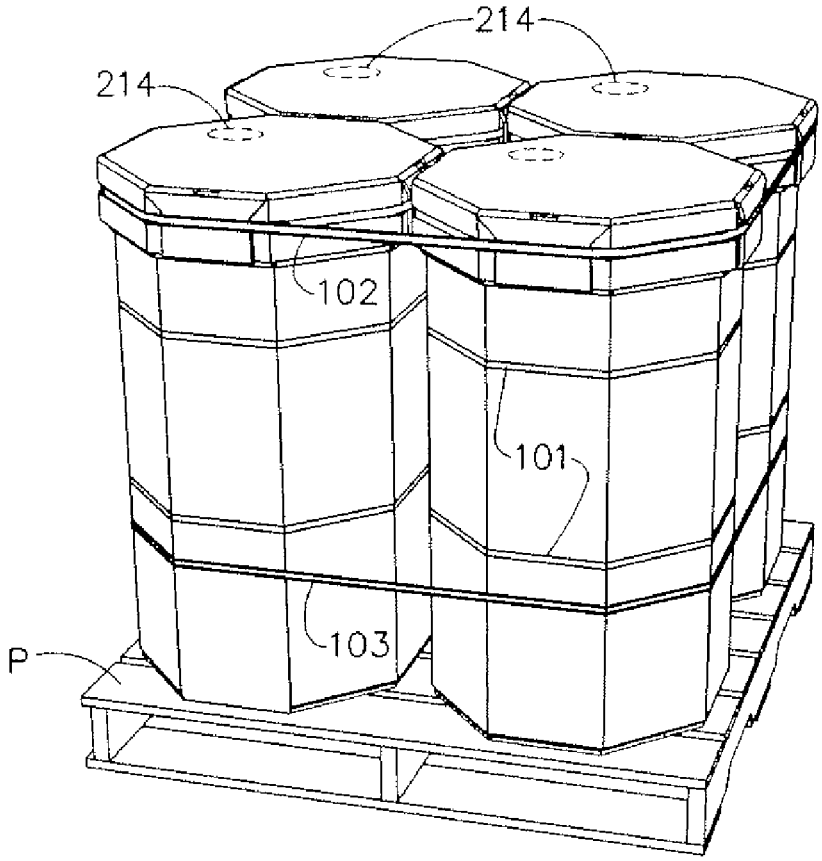
FIG. 26 shows several containers according to the invention with reinforcing bands applied to the sidewalls and with the containers strapped together and resting on a pallet.

Additional reinforcing straps 101 may be placed around the container at spaced locations along its height, as shown in FIG. 26. Plural containers may be placed on a pallet P and strapped together by bands 102 and 103, also as shown in FIG. 26.

Figure 27:
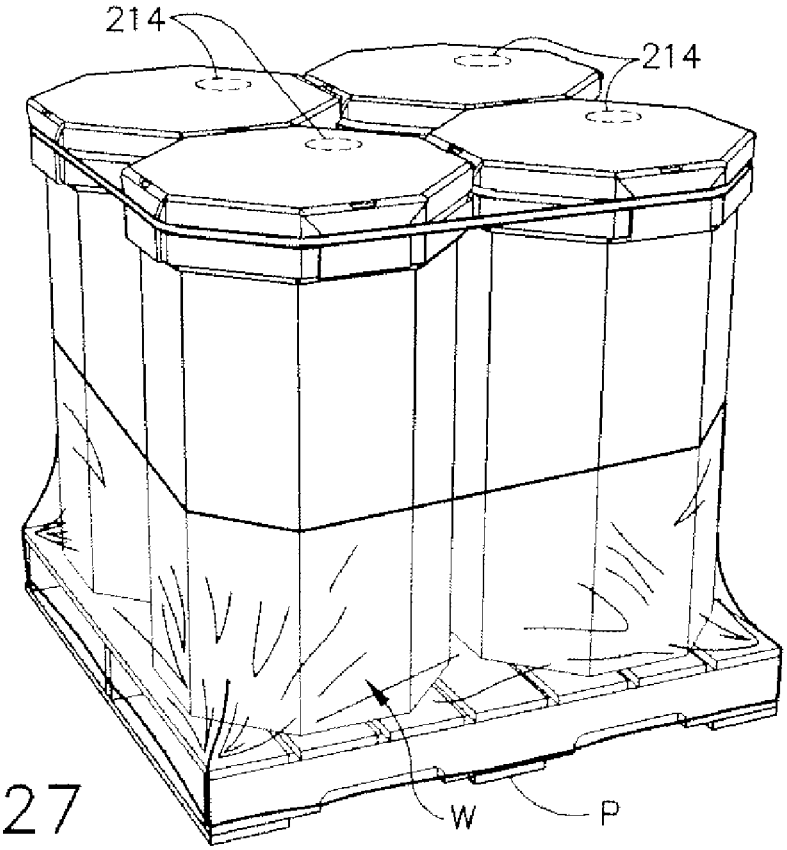
FIG. 27 depicts another way of securing several containers together and on a pallet, wherein stretch wrap is applied around the containers and a portion of the pallet.

In lieu of or in addition to the bands 102 and 103, stretch wrap or shrink wrap or the like W may be placed around a group of containers and a portion of the pallet P on which they are placed, as shown in FIGS. 25 and 27.

In FIG. 28 a pair of containers 200 is shown being lifted and carried by the tines of a forklift engaged beneath the rim 117 of the containers. The triple wall construction of the rim 117, its integral formation with the bin 111, its secure attachment to the bin sidewall, and the plurality of straight sections defined by it form a very strong and secure structure for lifting the container.

Figure 29:
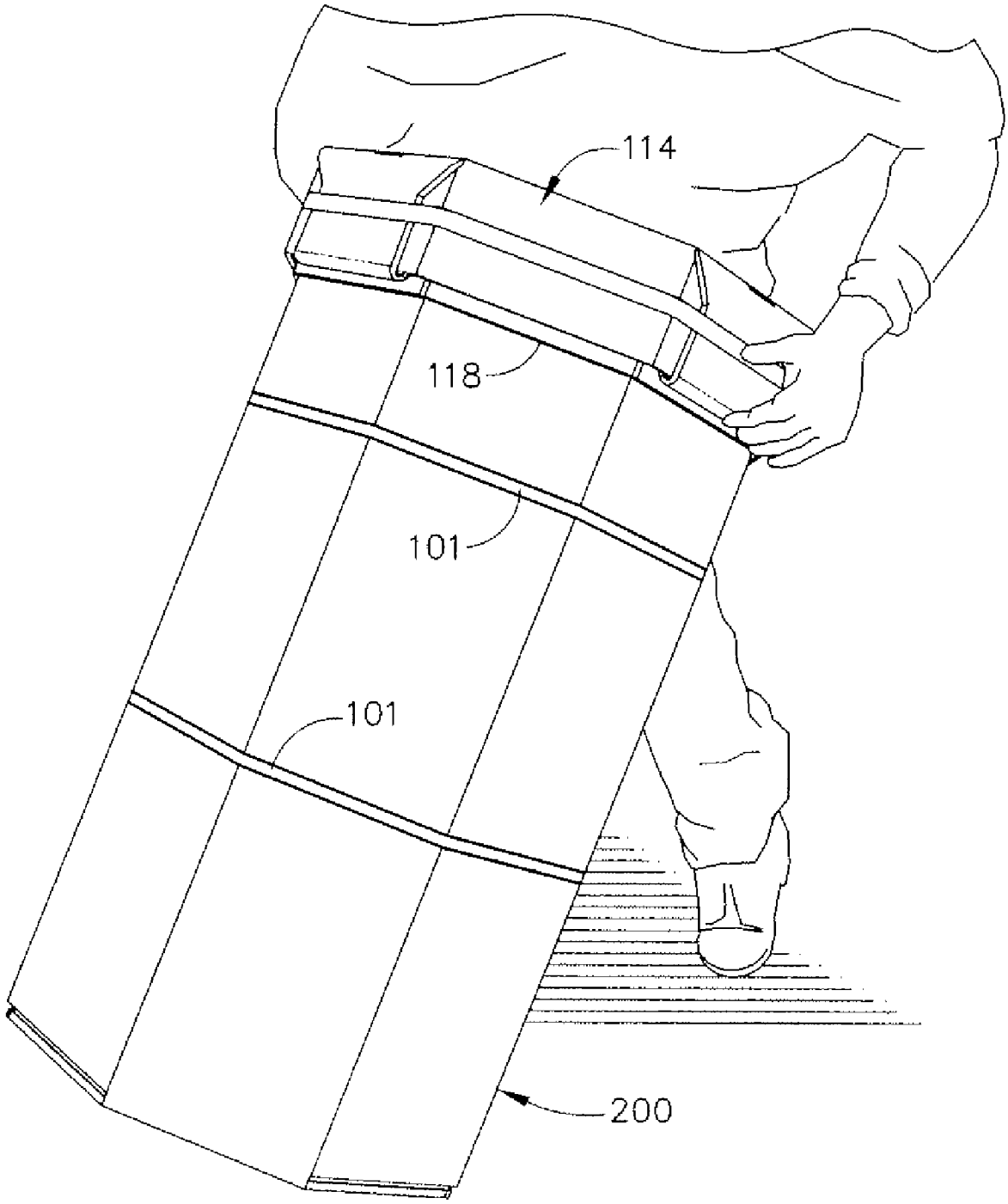
FIG. 29 depicts a container according to the invention having reinforcing bands applied to the lid and sidewall and being manually moved by rolling it on its bottom edge.

Further, as depicted in FIG. 29, the provision of a relatively wide rim at the top of the container and the construction of the container so that its sidewalls comprise a plurality of short straight sections provide good control of a container 10 being rolled on its bottom edge.

Figure 30:
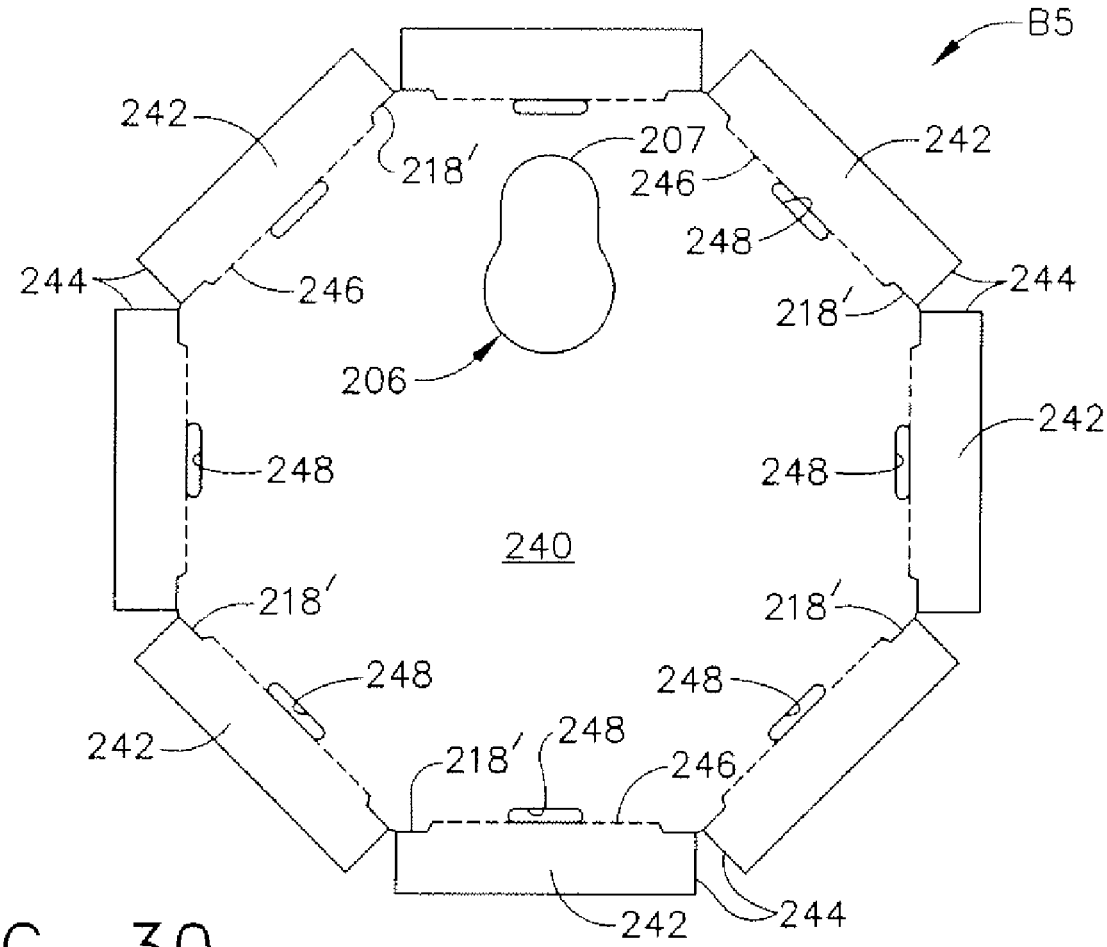
FIG. 30 is a plan view of a blank for making a fill valve support tray according to a preferred embodiment of the invention.
Figure 32:
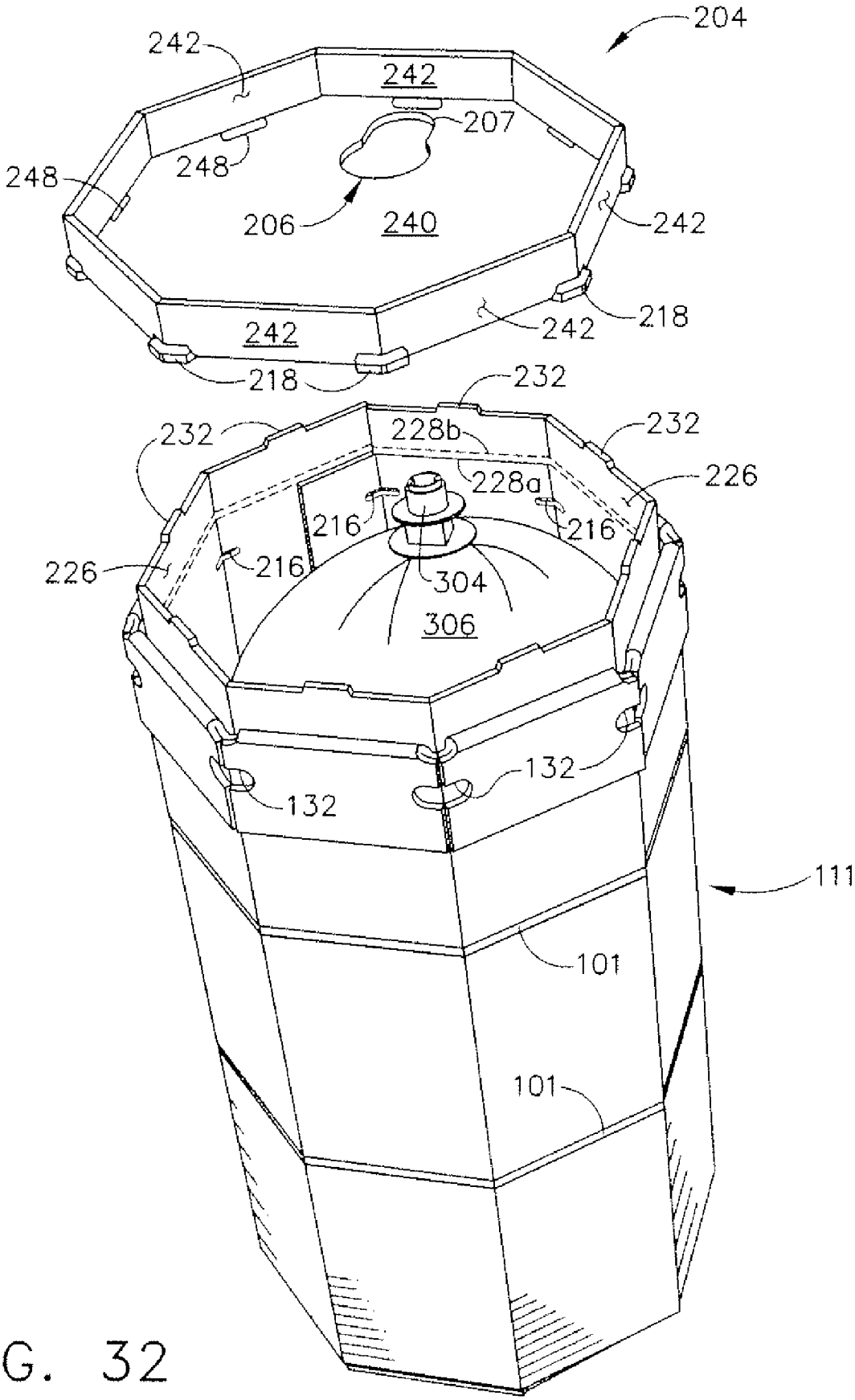
FIG. 32 is an exploded perspective view of the bin including the liner and the fill valve support tray.

Referring to FIG. 30 which is a plan view of a blank B5 for making the valve support tray 204 as shown in FIG. 31 according to a preferred embodiment of the invention. The blank B5 comprises a central panel 240 shaped corresponding to the shape of the liner insert 202, octagonal in the example shown on FIG. 32—and flaps 242 extending from each straight edge of the central panel 240. The flaps 242 are separated from one another by cutouts 244 that terminate on respective cut lines 218' and fold lines 246 joining the respective flaps to the central panel 150. The cut lines 218' forms the tray tabs 218 the flaps 242 are simply folded upwardly as shown in FIG. 31. The tray tabs 218 extends outwardly beyond the bottom edge of the flaps 242 when they are folded upwardly as depicted in FIG. 32. Slots 248 are formed in the central panel 240 adjacent the midpoint of each of the fold lines 246. Each of the slots 248 are sized to receive the respective liner flanges 232 of the liner insert 202 when liner flanges 232 fold over and lock into the valve support tray 204. The opening 206 includes an elongated portion 207 formed therein to be engaged with the discharge valve as will be discussed in greater detail hereinbelow.

FIG. 32 is an exploded perspective view of the bin 111 including the liner insert 202 and the valve support tray 204. As noted hereinabove, the tray tabs 218 are sized corresponding to the size of the liner slots 216 so that the valve support tray 218 is securely attached to the liner insert 202 as depicted in FIG. 33.

Figure 34:
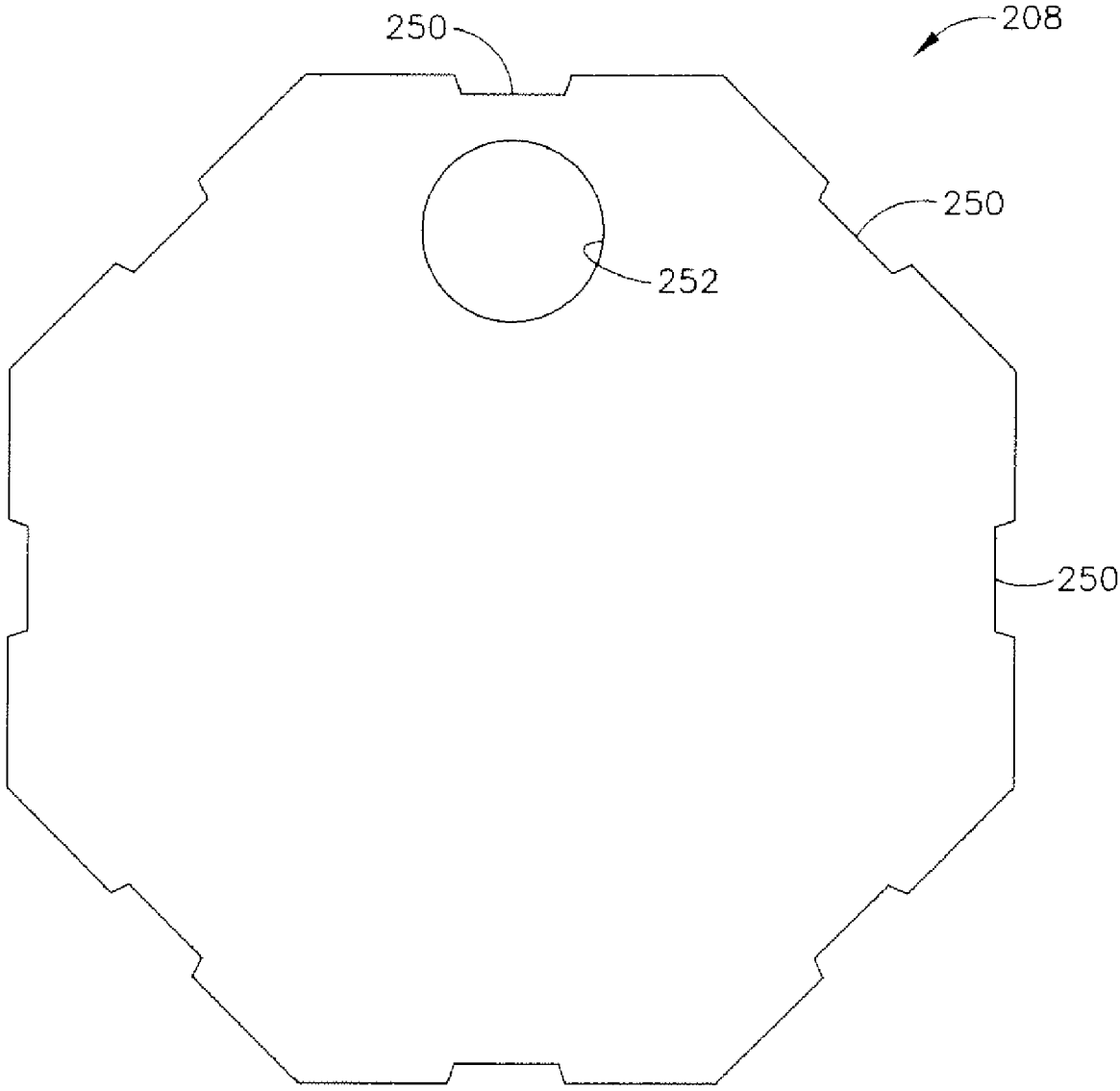
FIG. 34 is a plan view of a locking pad incorporated with the fill valve support tray.

FIG. 34 is a plan view of a locking pad 208 incorporated with the valve support tray 218. The locking pad 208 is octagonal in shape and sized substantially similar to the valve support tray 204. A plurality of pad notches 250 are formed in the midpoint of each straight edge of the locking pad 208. The pad notches 250 are sized corresponding to the size of the liner flanges 232. Furthermore, the locking pad 208 includes a pad recess 252 sized corresponding to the size of the discharge valve. The locking pad 208 is used to lock the discharge valve in place within the valve support tray 204.

Figure 33:
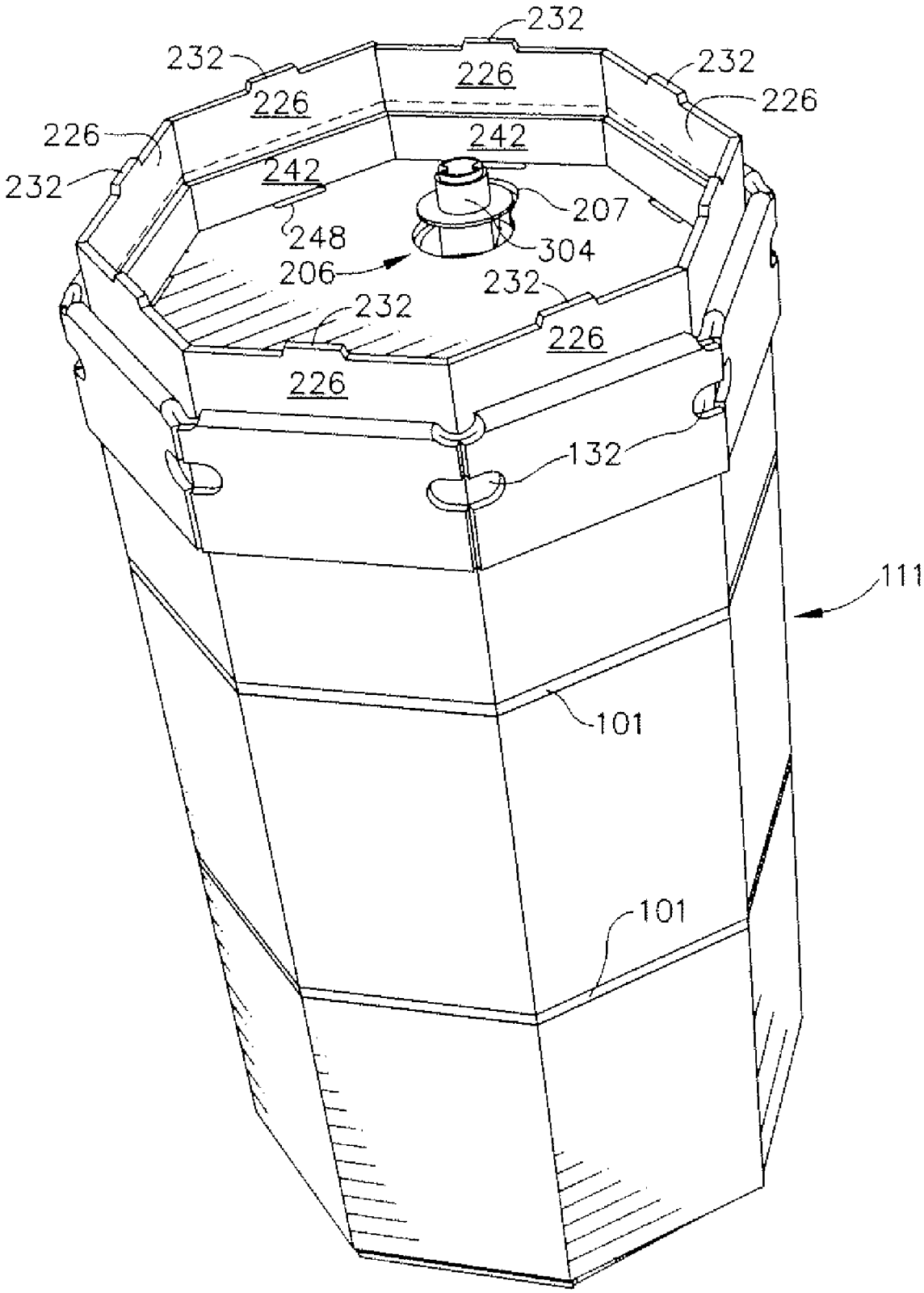
FIG. 33 shows the fill valve support tray engaged with the liner.
Figure 35:
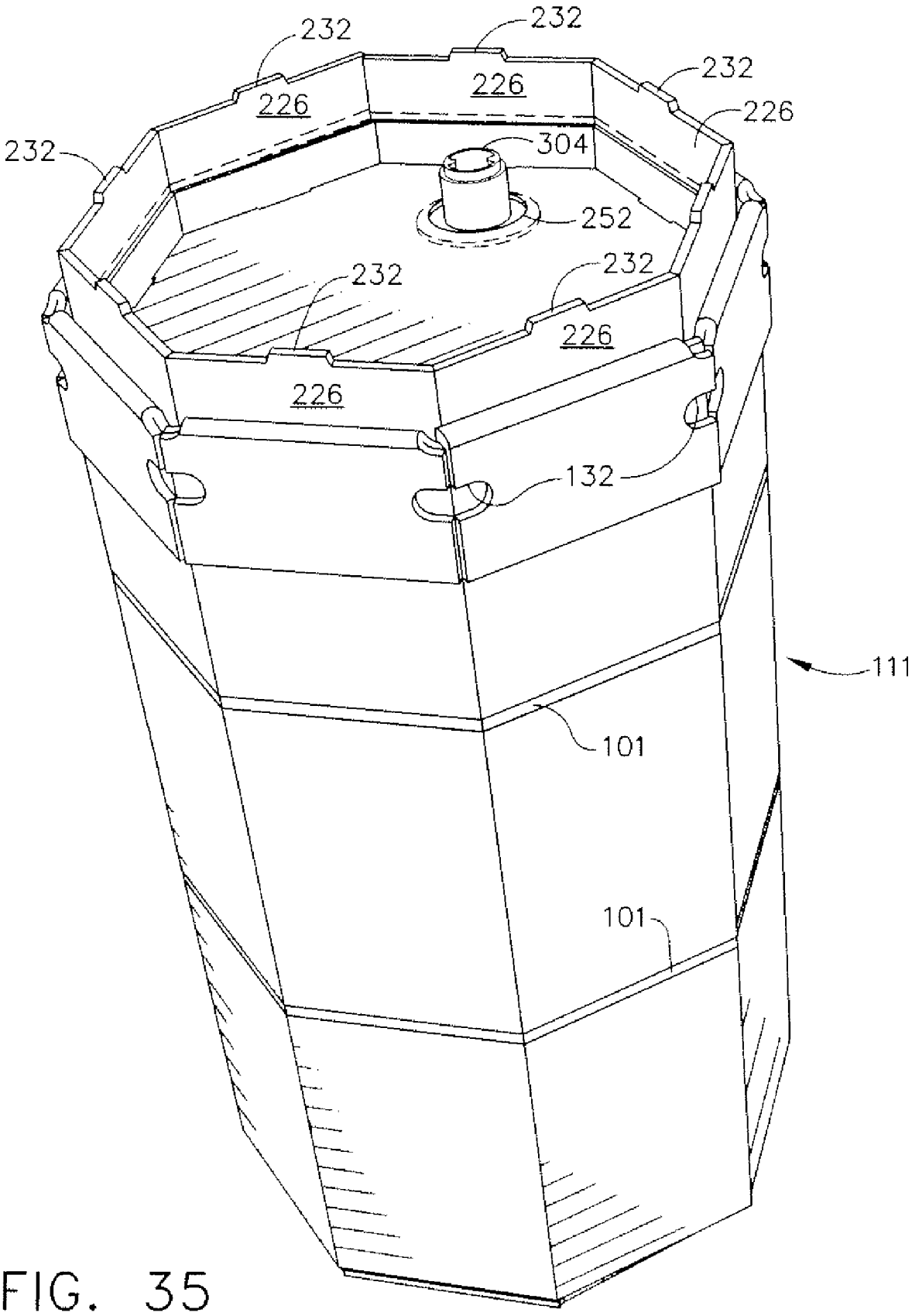
FIG. 35 is a perspective view of the bin having the liner, fill valve support tray, and the locking pad positioned therein.
Figure 36:
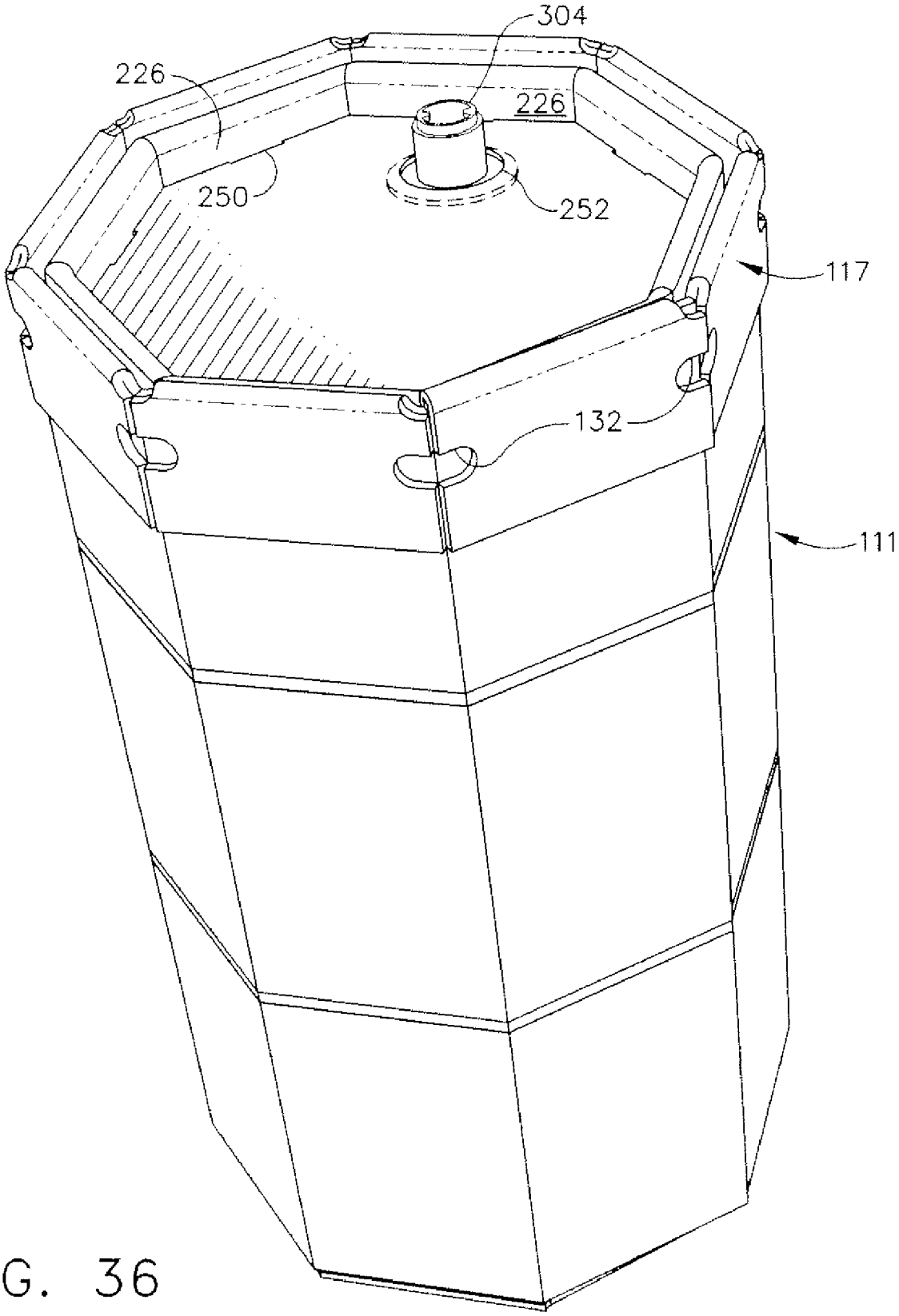
FIG. 36 is similar to FIG. 35, illustrating the liner flange fully engaged with the fill valve support plate, and the locking pad.

In use, the bag having a discharge valve attached thereto is disposed in the bin 111 as shown in FIG. 33; the bag is filled with the liquid through the discharge valve. Next, the valve support tray 204 is placed within the liner insert 202 such that the discharge valve extends out from the opening 206 and slightly pushed in the elongated portion 207. Then, the locking pad 208 is positioned within the central panel 240 of the valve support tray 204 so that the pad notches 250 are aligned with the slot 248 and the discharge valve extends out from the locking pad recess 252. This arrangement securely locks the discharge valve in proper position and prevents the discharge valve from any movement. Finally, the Rim-forming flaps 226 having the liner flange 232 are fold over and lock into the slot 248 in the valve support tray 204 as depicted in FIGS. 35, 36.

Figure 37:
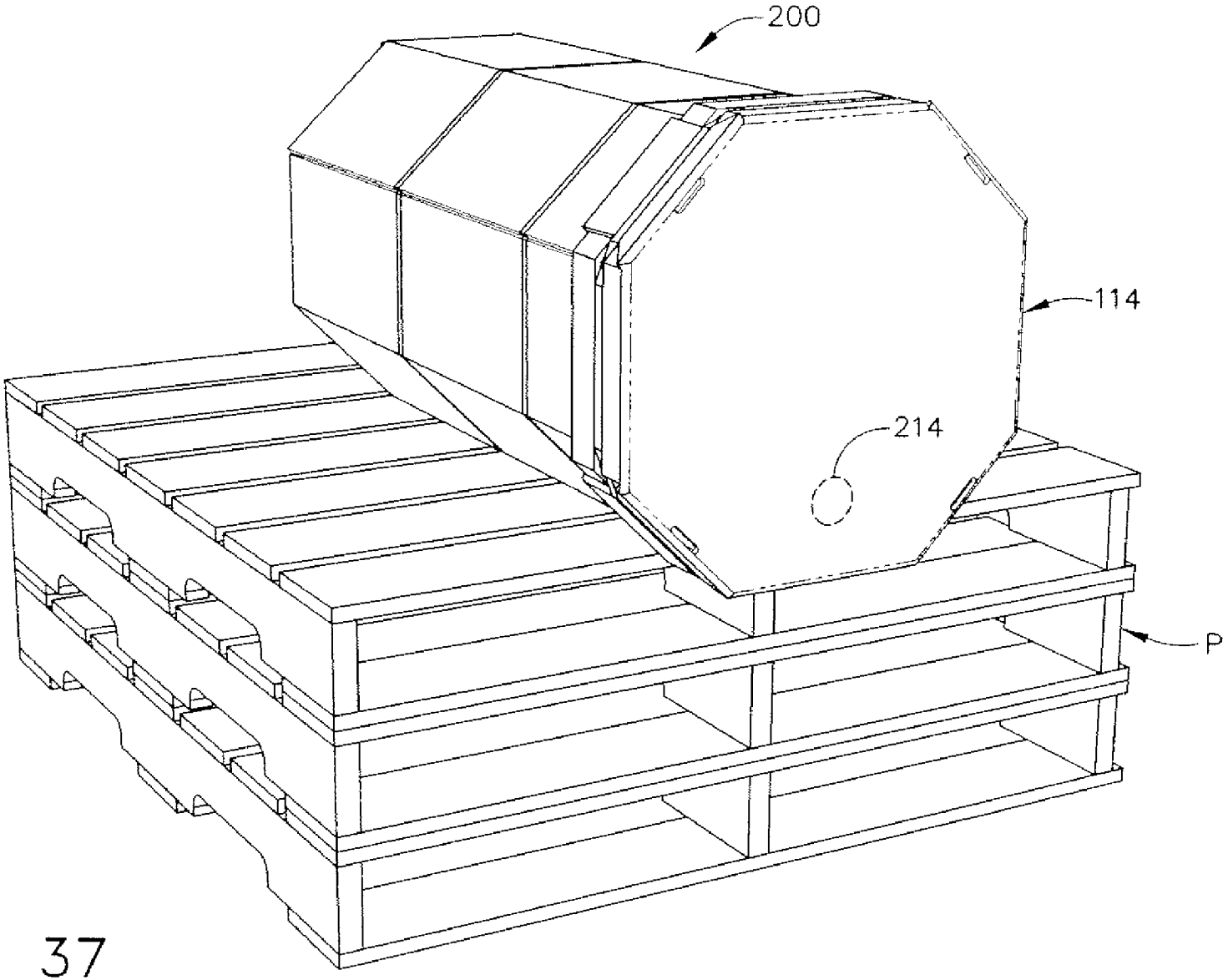
FIG. 37 shows the container according to the invention with reinforcing bands applied to the sidewalls of the container and resting on a pallet.
Figure 38:
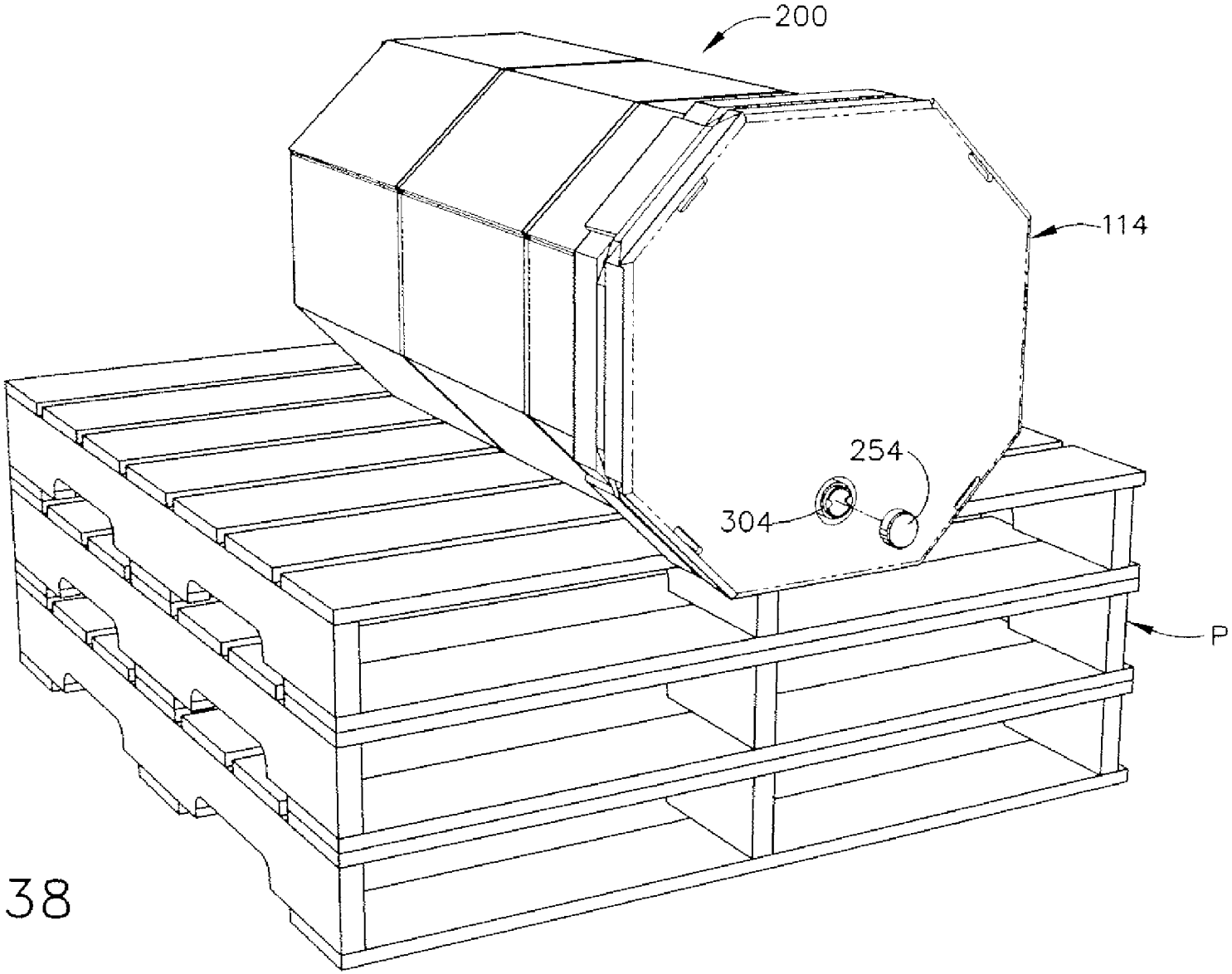
FIG. 38 is the same as FIG. 37, illustrating a cap used on the discharge valve.

FIG. 37 shows the container according to the invention with reinforcing bands applied to the sidewalls of the container 200 and resting on a pallet. Generally, to discharge the liquid from the bag, the container 200 is positioned on its sidewalls and the perforated line area 214 is punched out to expose the discharge valve so that the liquid is discharged under the weight of liquid and the gravity force from the container. To store the liquid in the container 200 for future use, a cap 254 is used to enclose the discharge valve as shown in FIG. 38.

Figure 39:
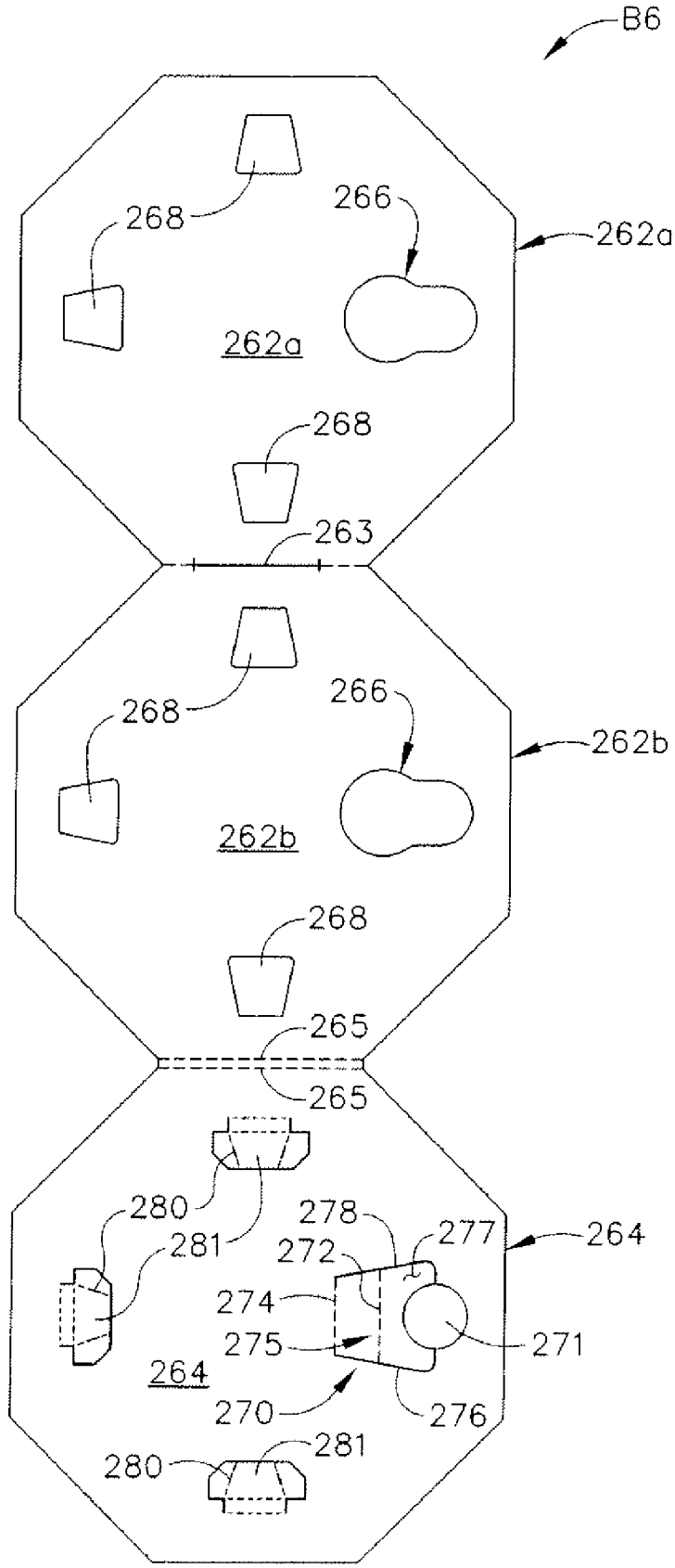
FIG. 39 is a plan view of a blank for making a fill valve support plate according to another preferred embodiment of the invention.
Figure 40:
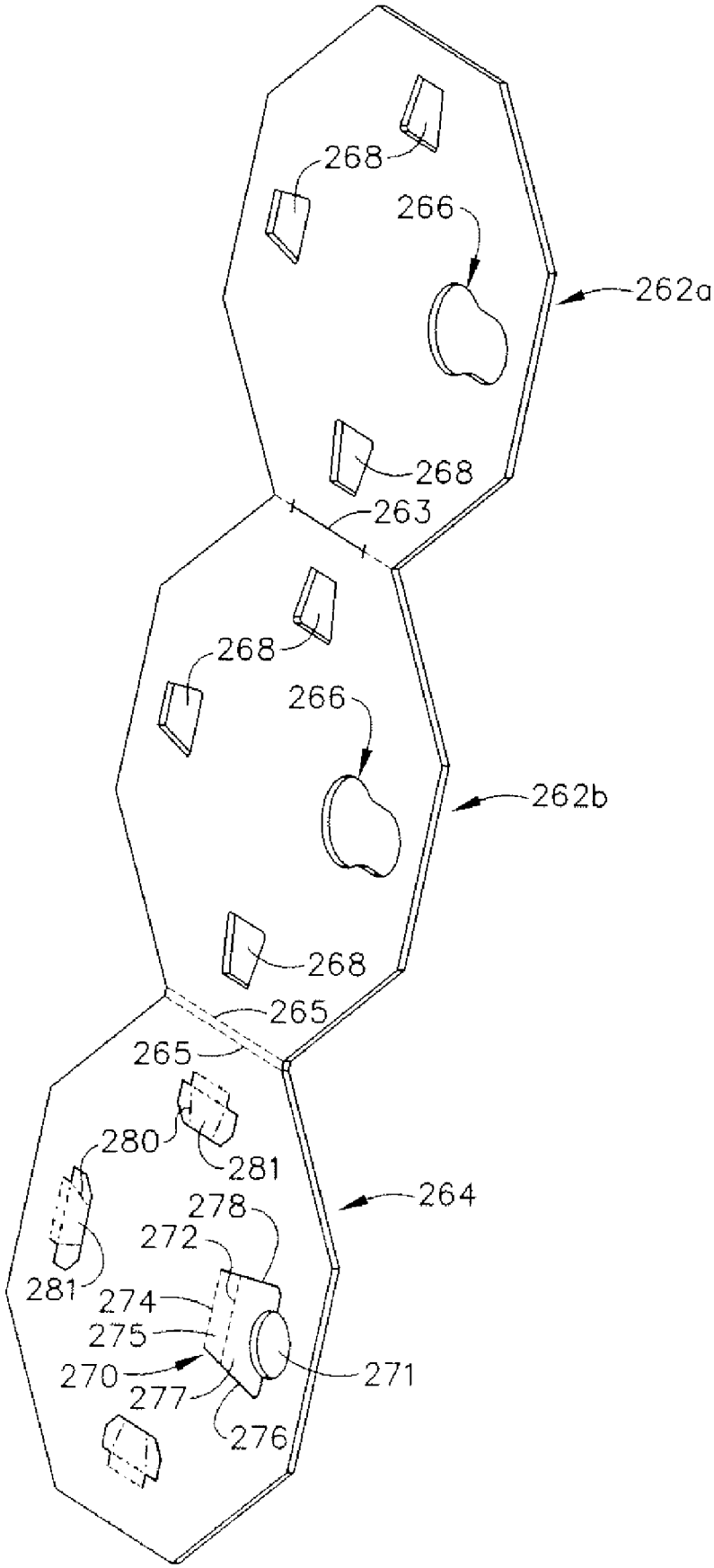
FIG. 40 is a perspective view showing the thickness of the blank of FIG. 39.
Figure 41:
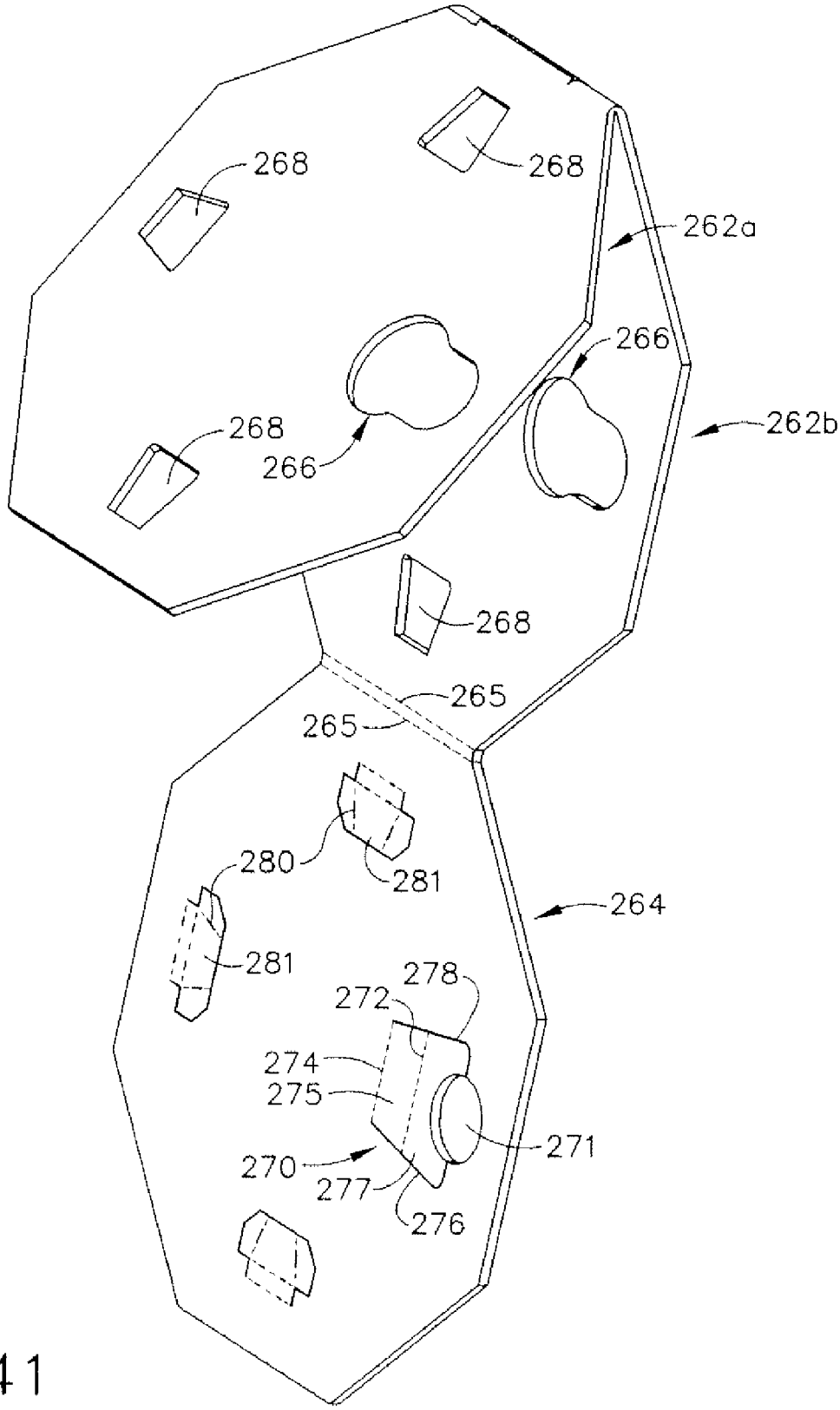
FIGS. 41-42 show the blank of FIG. 39 in partially folded position.
Figure 42:
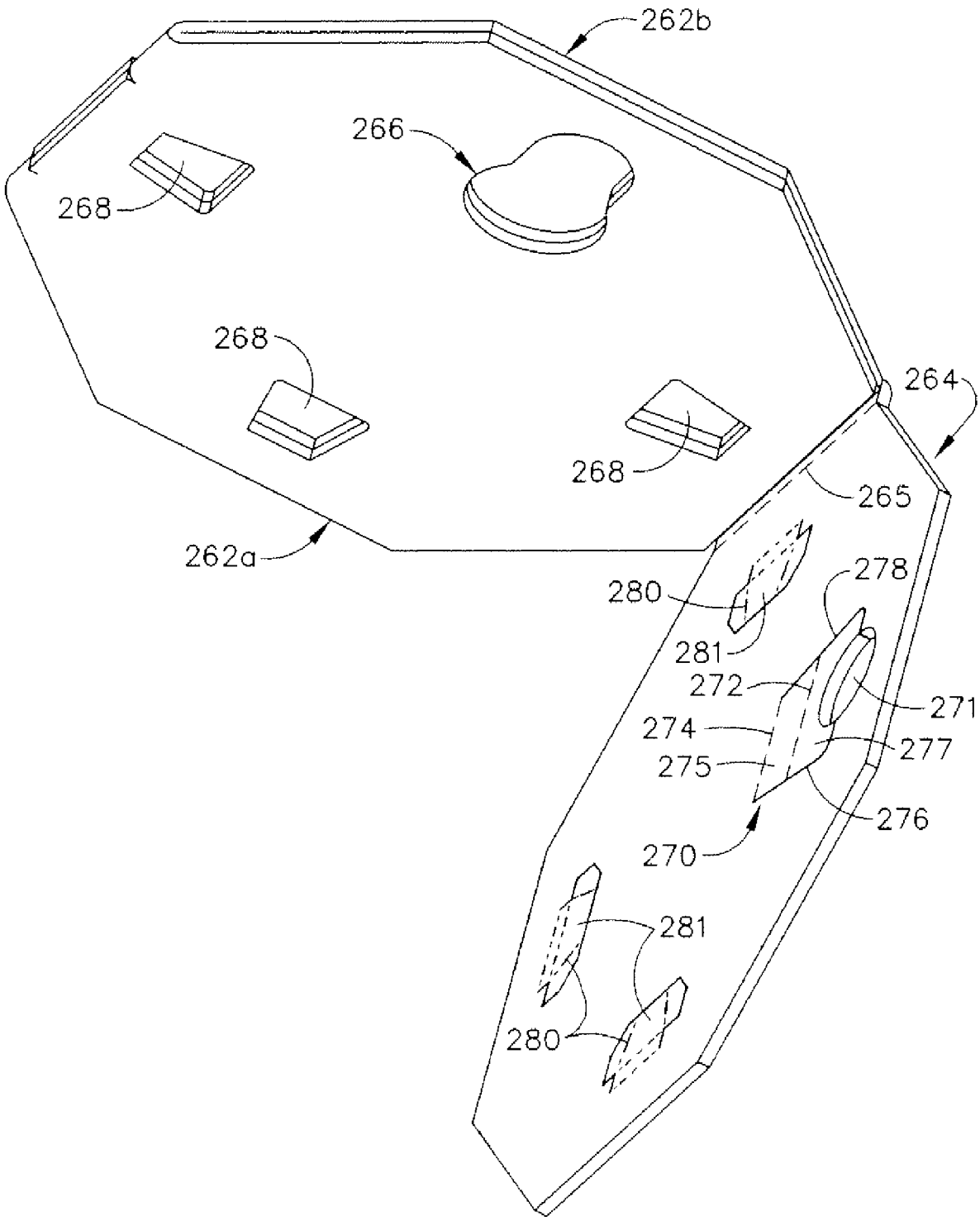

FIG. 39 is a plan view of a blank B6 for making a fill valve support plate 260 in accordance to another preferred embodiment of the invention. The blank B6 includes three panels 262*a*, 262*b*, and 264 that are defined by fold lines 263, 265. The two panels 262*a*, 262*b* are support panels and the third panel is the fill valve support panel. The panels 262*a*, 262*b* are defined by fold line 263 and when these panels are folded onto one another the panels 262*a* and 262*b* provide a much stronger support for the fill valve support plate 260. Each of the panels 262*a* and 262*b* includes an oblong opening 266 that are formed near the edge thereof and are sized the same. Three identically shaped openings 268 are formed through the panels 262*a* and 262*b* in an outwardly spaced relationship to the oblong opening 266 for the purpose described below. The panel 264 includes a generally rectangular valve tab 270 formed by two cut lines 276, 278 and two parallel fold lines 272, 274. One end of the valve tab 270 includes the fold line 274 and the opposite end of the valve tab 270 forms an opening 271. The valve tab 270 is defined by first and second portions defined by fold line 272. The first portion is a web 275 and the second portion is a flexible tab 277. The valve tab 270 is engaged with the discharge valve when the fill valve support plate 260 is disposed within the container 200. Three perforated cut lines 280, generally rectangular in shape, are formed in an outwardly spaced relationship to the valve tab 270. These perforated cut lines 280 are sized the same as the openings 268 and correspond to respective opening 268. The perforated cut lines 280 are made in the panel 264 to define bendable tabs 28 that flex and lock behind the fill valve support plate 260 when the two panels 262*a*, 262*b* are folded onto the panel 264. With respect to the three openings 268 and the three cut lines 280, alternatively, only one opening 268 and one respective cut line 280 is sufficient to securely lock the panels 262*a*, 262*b* to the panel 264.

Figure 43:
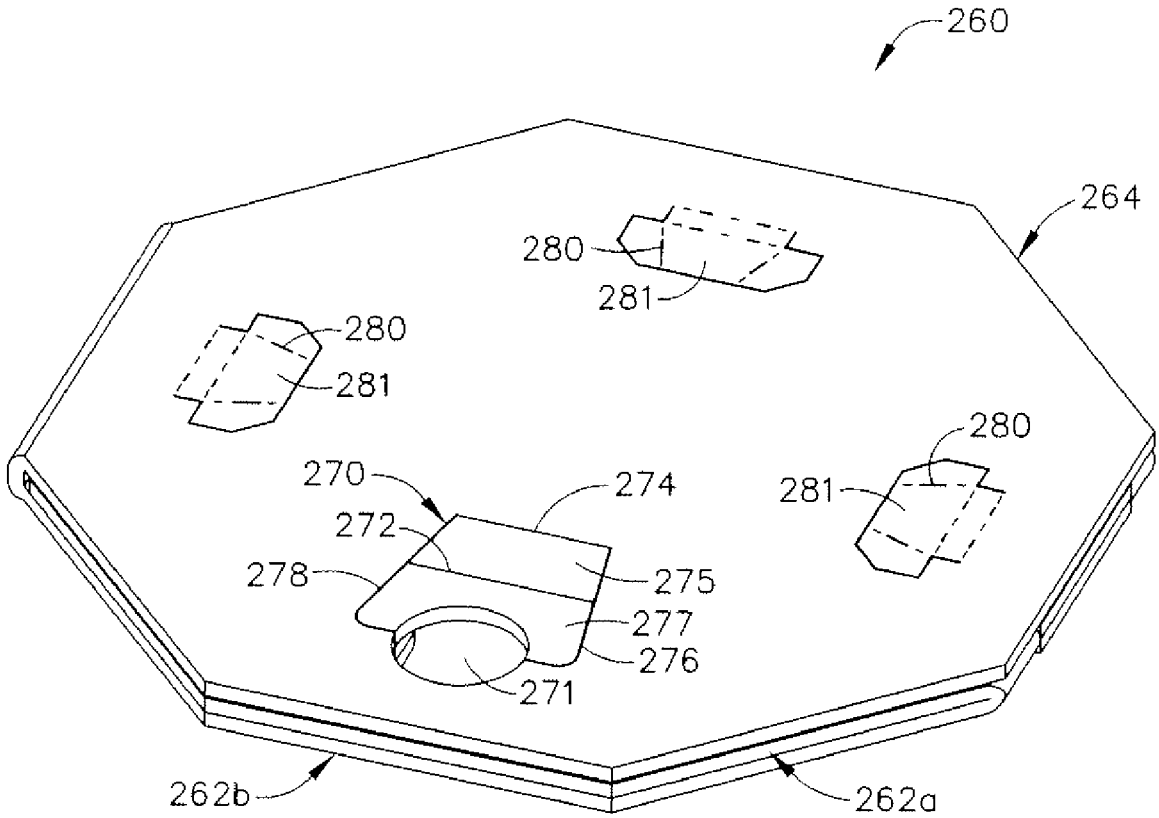
FIG. 43 is a top perspective view of the fill valve support plate constructed from the blank in FIG. 39 according to another preferred embodiment of the invention.

FIGS. 40-43 illustrate the folding sequences in which the fill valve support plate 260 is constructed. First, panels 262*a*, 262*b* are folded onto one another along the fold line 263 and in a manner that the corresponding openings 268 in each panel 262*a*, 262*b* are aligned with one another and the corresponding oblong openings 266 in the each panel are aligned with one another as well. Then the panel 264 is folded onto the two panels 262*a*, 262*b* along the double fold lines 265 as shown in FIG. 43. When the three panels 262*a*, 262*b*, and 264 are in the folded position, the three openings 268 in the panels 262*a*, 262*b* are concealed by the perforated cut lines 280 and a portion of the oblong opening 266 is covered by the valve tab 270.

Figure 44:
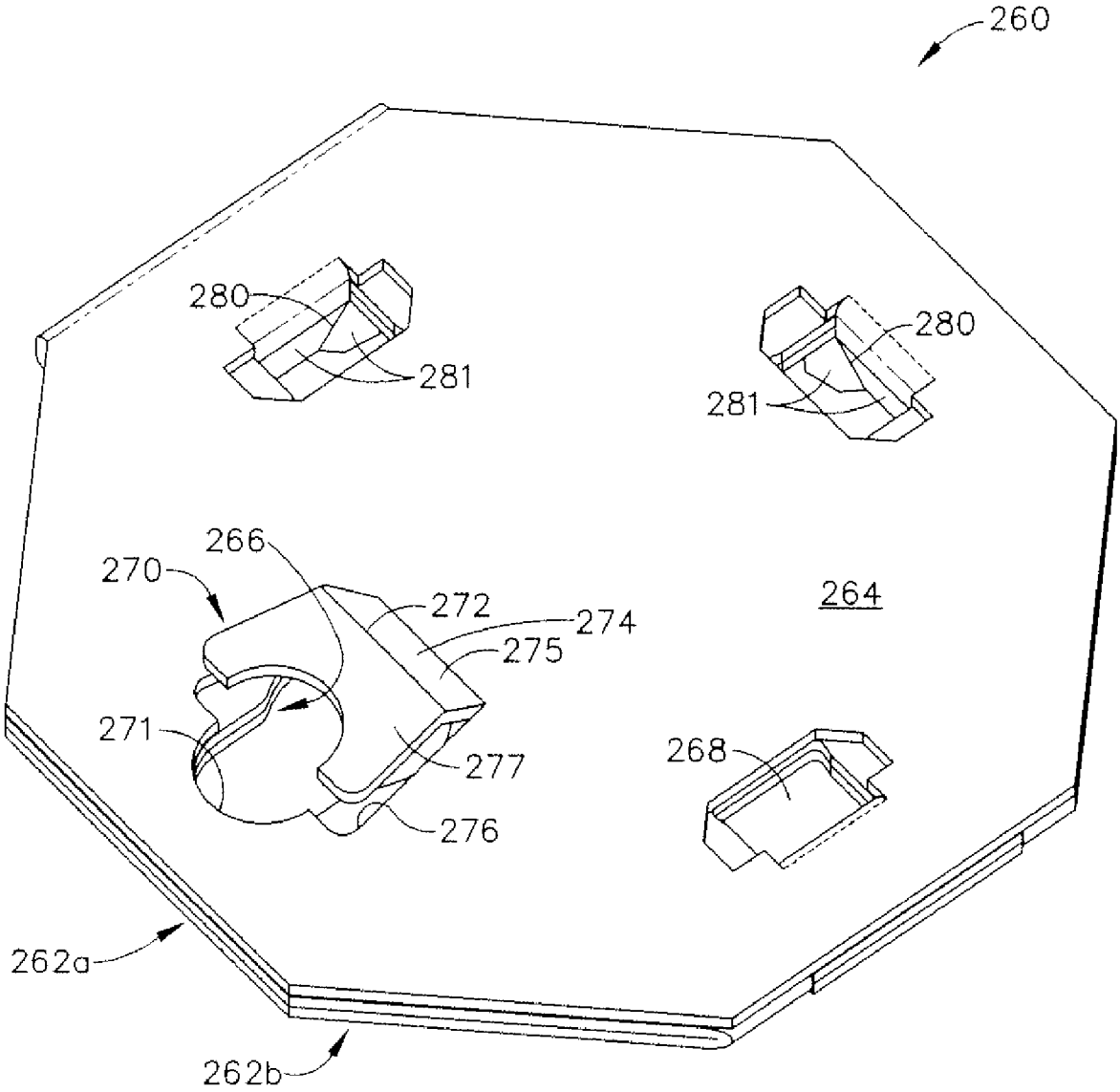
FIG. 44 is the similar to FIG. 43, illustrating the recess area for placing a discharge valve therethrough.
Figure 45:
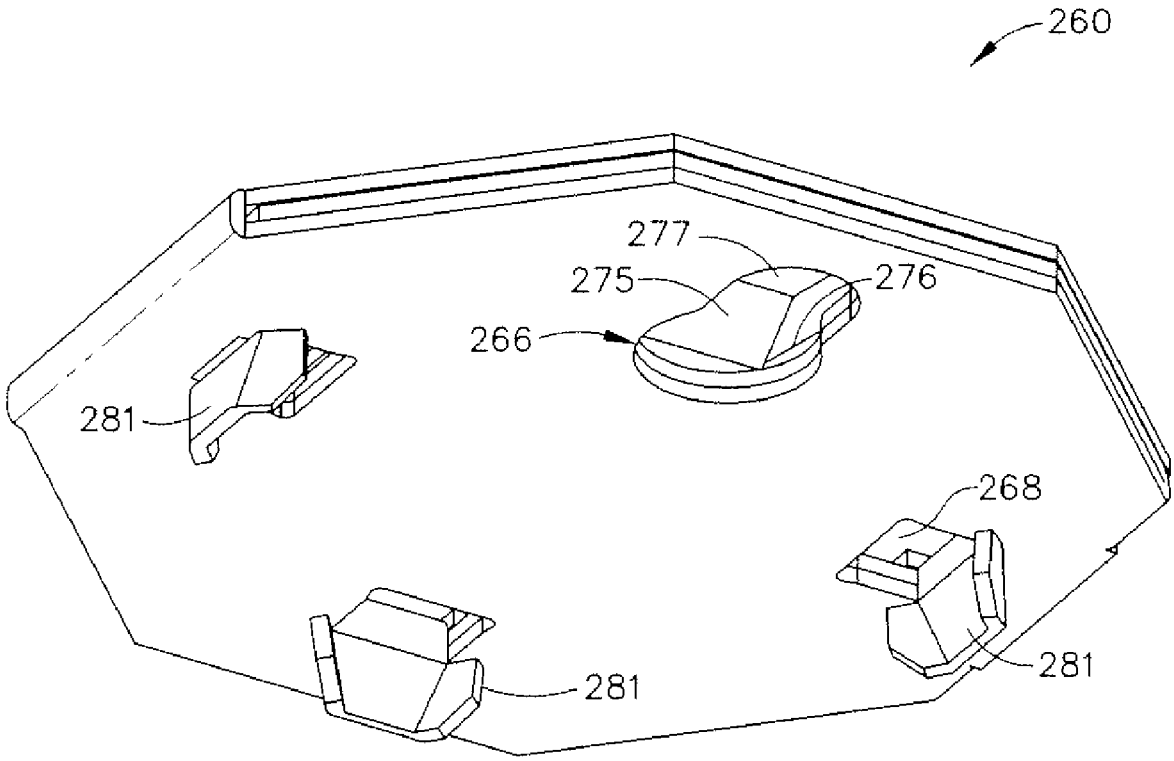
FIG. 45 is the similar to FIG. 44, shown the underside of the fill valve support plate.

As noted above, to securely lock the two panels 262*a*, 262*b* onto the panel 264, the bendable tabs 281 are bent downwardly which the tabs flexing through the openings 268 and then springing out to lock the three panels to one another as illustrated in FIGS. 43-45. To open the valve tab 270, the flexible tab 277 is grasped and lifted upwardly, pivoting the web 275 upwardly.

Figure 46:
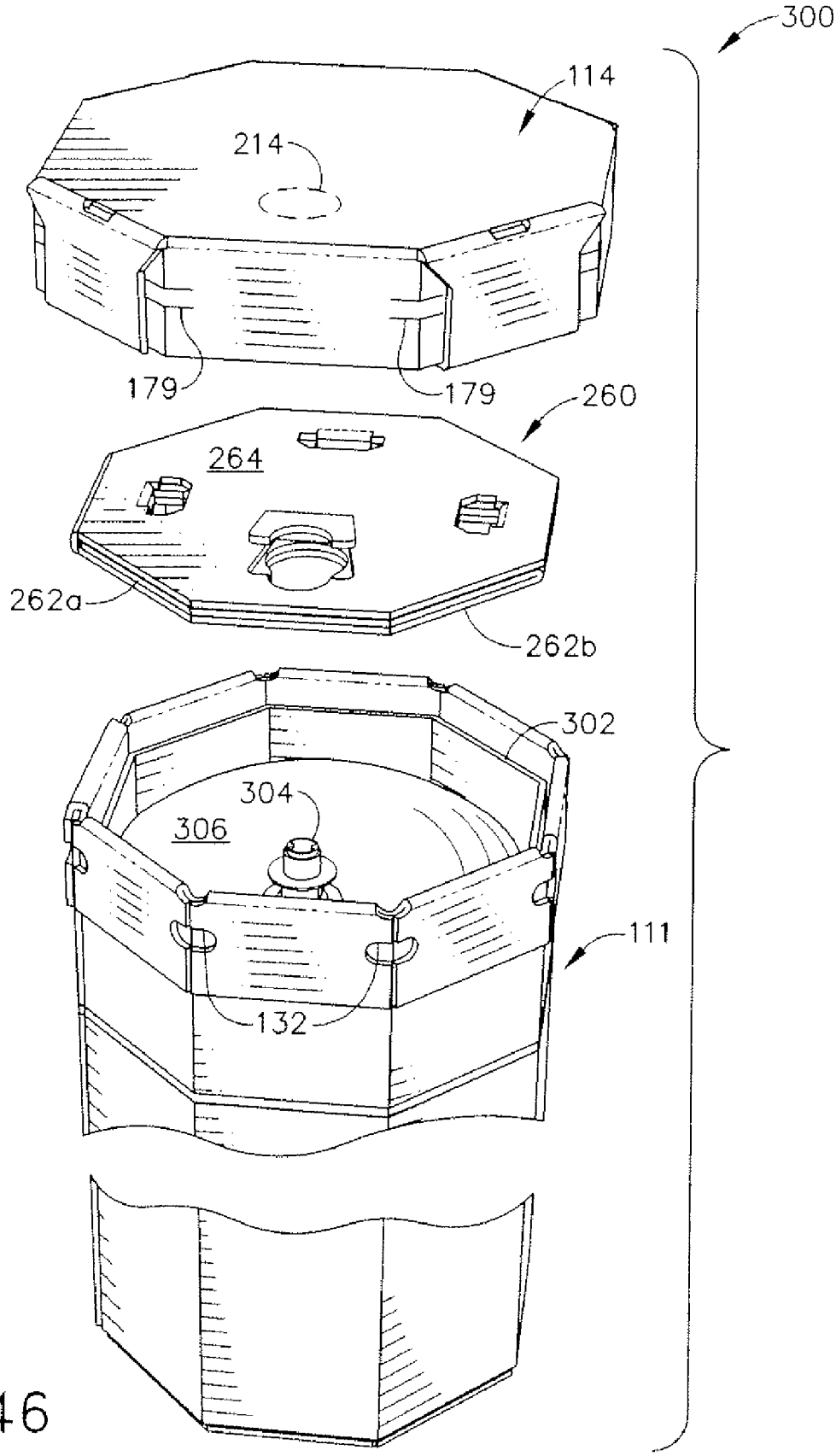
FIG. 46 is an exploded perspective view of the fill valve support plate, the lid and the bin having the liner disposed therein, according to a preferred form of the invention.
Figure 47:
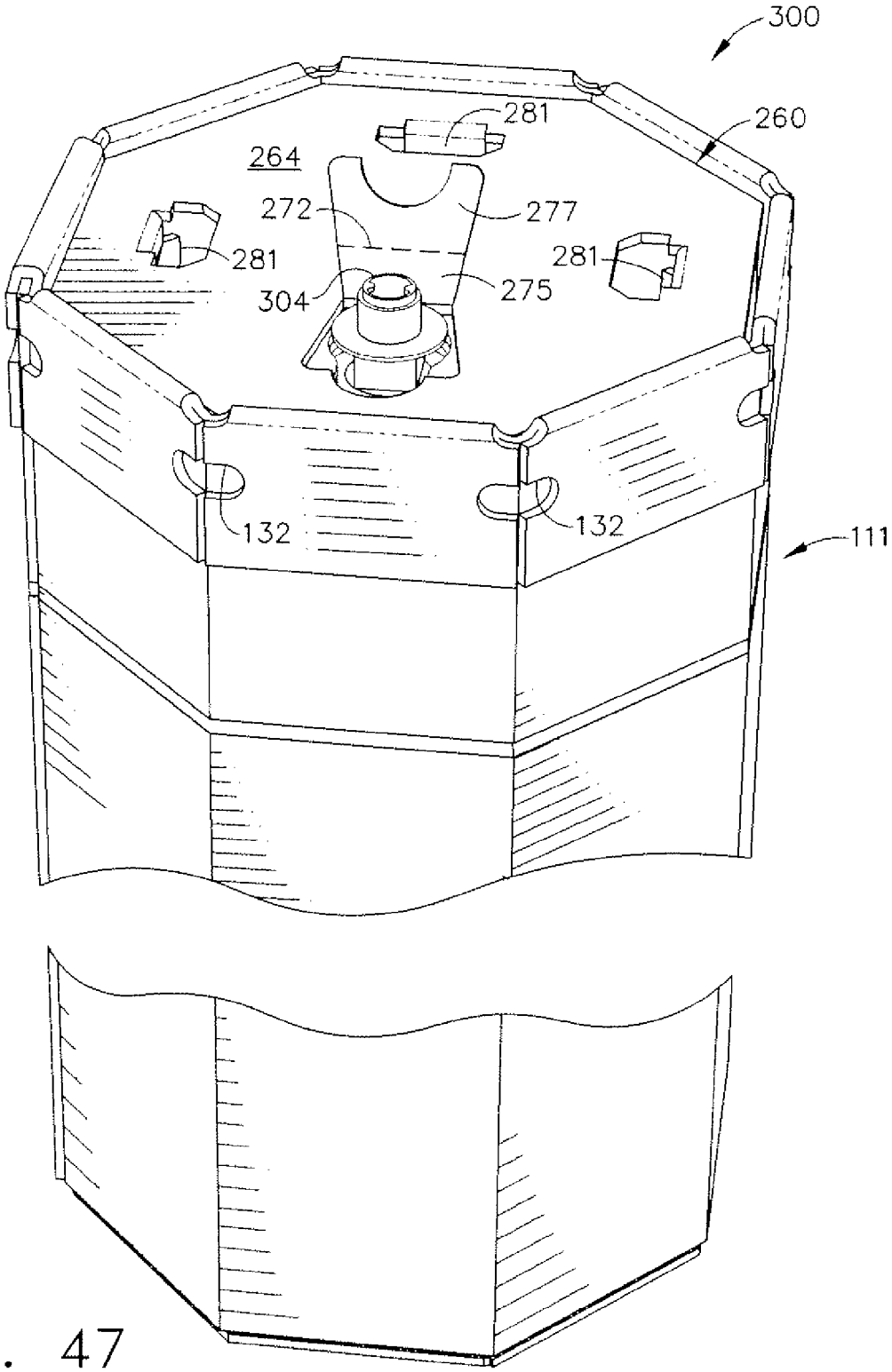
FIG. 47-48 is similar to FIG. 46, illustrating a top perspective view of a container in an assembled position in accordance to the preferred form of the invention.
Figure 48:
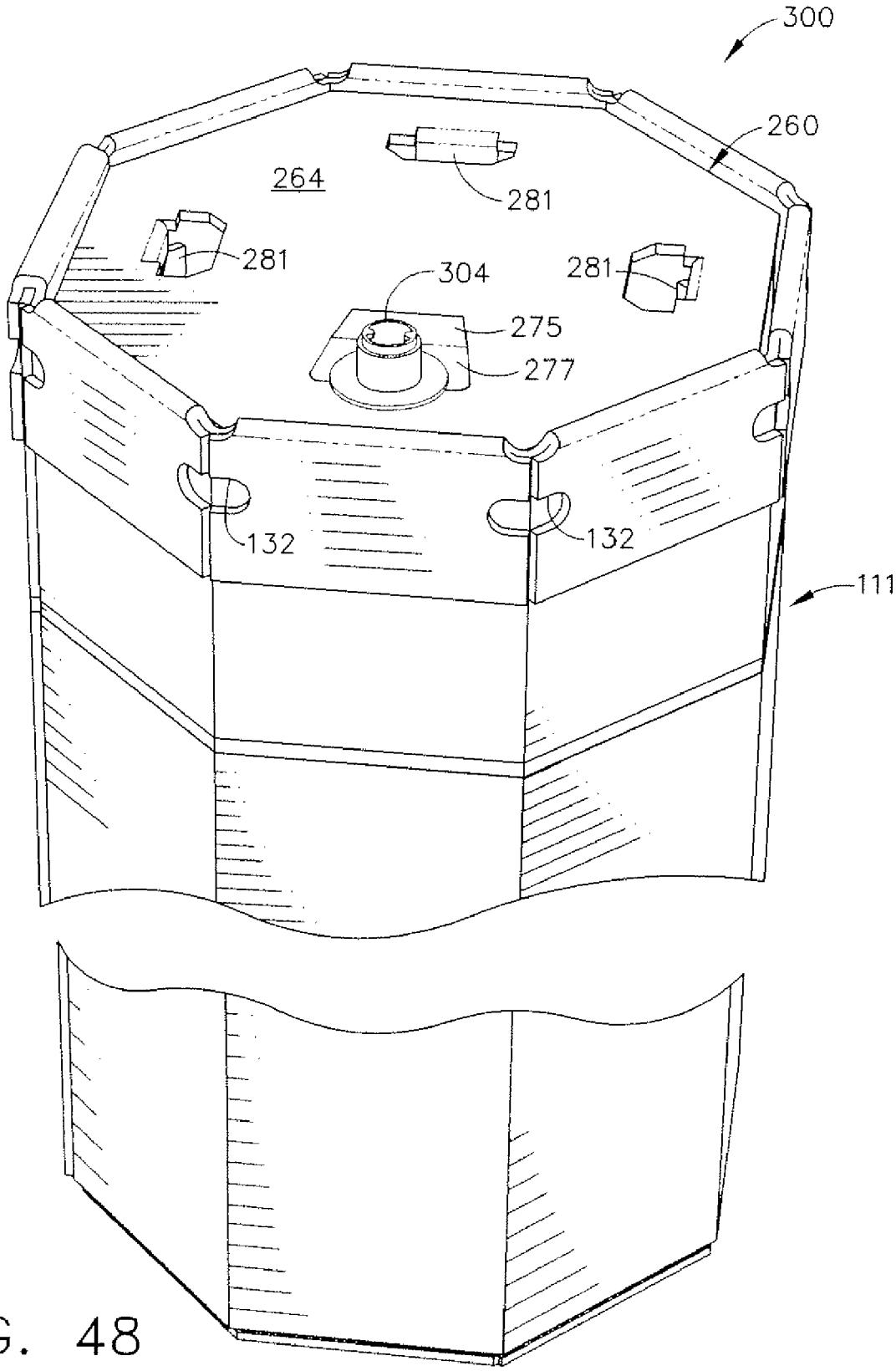

FIG. 46 is an exploded perspective view of a container 300 having the lid 114; the fill valve support plate 260, the bin 111 and the liner insert 123 disposed therein according to a further embodiment of the invention. The liner insert 123 has a plurality of side panels corresponding in number to the side panels of the bin 111. The liner insert 123 is substantially similar to the liner insert 202 (FIG. 14) with the exception of the slots 216, the liner flanges 232, and the double score line 228. In use, the tray insert 122 is placed in the open upper end of the bin 111 and the liner insert 123 positioned in the tray and pushed down into the bin 111 as shown in exploded view in FIG. 2. In this embodiment of the invention, the liner insert 123 is shortened so that its upper end 302 is spaced below the upper end of the bin sidewall. The fill valve support 260 is placed on the upper end 302 of the liner insert to rest between the liner insert 123 and the lid 114. The thickness of the fill valve support 260 is equivalent to the space below the upper end of the bin side wall and the liner insert 123 so that the top surface of the fill valve support 260 is aligned with the upper end of the bin side wall. The discharge valve 304 extends outwardly from the valve tab opening 206 and slightly pushed to the elongated portion 207 as shown in FIG. 47. After fully engaging the discharge valve 304 with the valve tab 270, the flexible tab 277 is pushed downward to securely hold the discharge valve in place as shown in FIG. 48.

Figure 49:
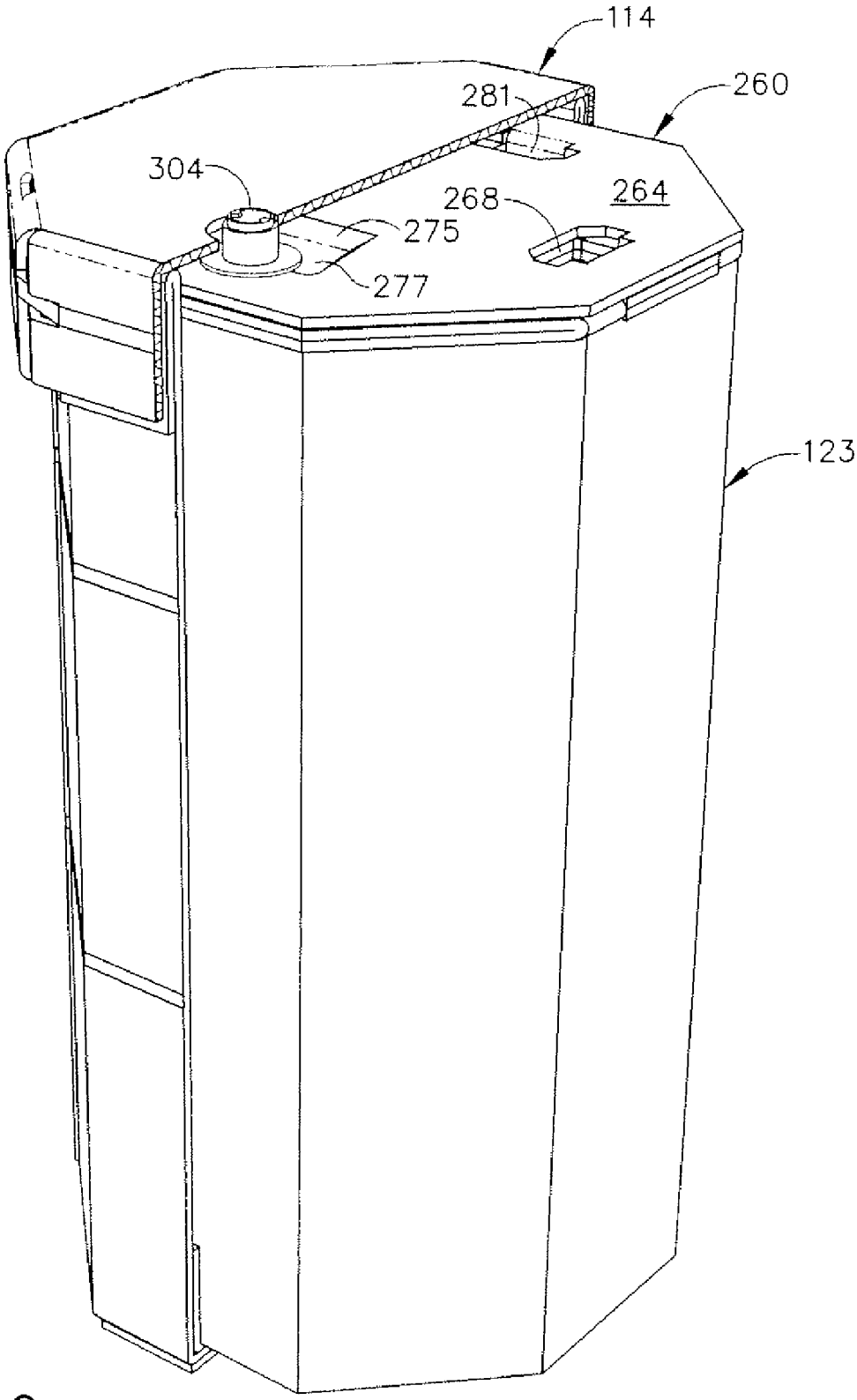
FIG. 49 is a partially cut away top perspective view of the container exposing the inner of the container.

FIG. 49 is a partially cut away top perspective view of the container 300 exposing the relative heights of the bin 111 and liner insert 123. In addition, the discharge valve is slightly protruded through the opening 212 in the lid 114. The assembled container 300 is octagonal in shape; however, other polygonal or modified polygonal shapes may be used. The various elements of the container 300 such as the bin 111, liner insert 202, valve support tray, fill valve support plate 260, and the like can be shipped to the user so that the container can be assembled where it is to be filled. The container 300 by virtue of its construction from inexpensive paperboard may be utilized multiple times, for a variety of uses in addition to storage, transport and dispensing of liquids. Alternatively, the container 300 may be utilized only once and then discarded, if desired.

Figure 50:
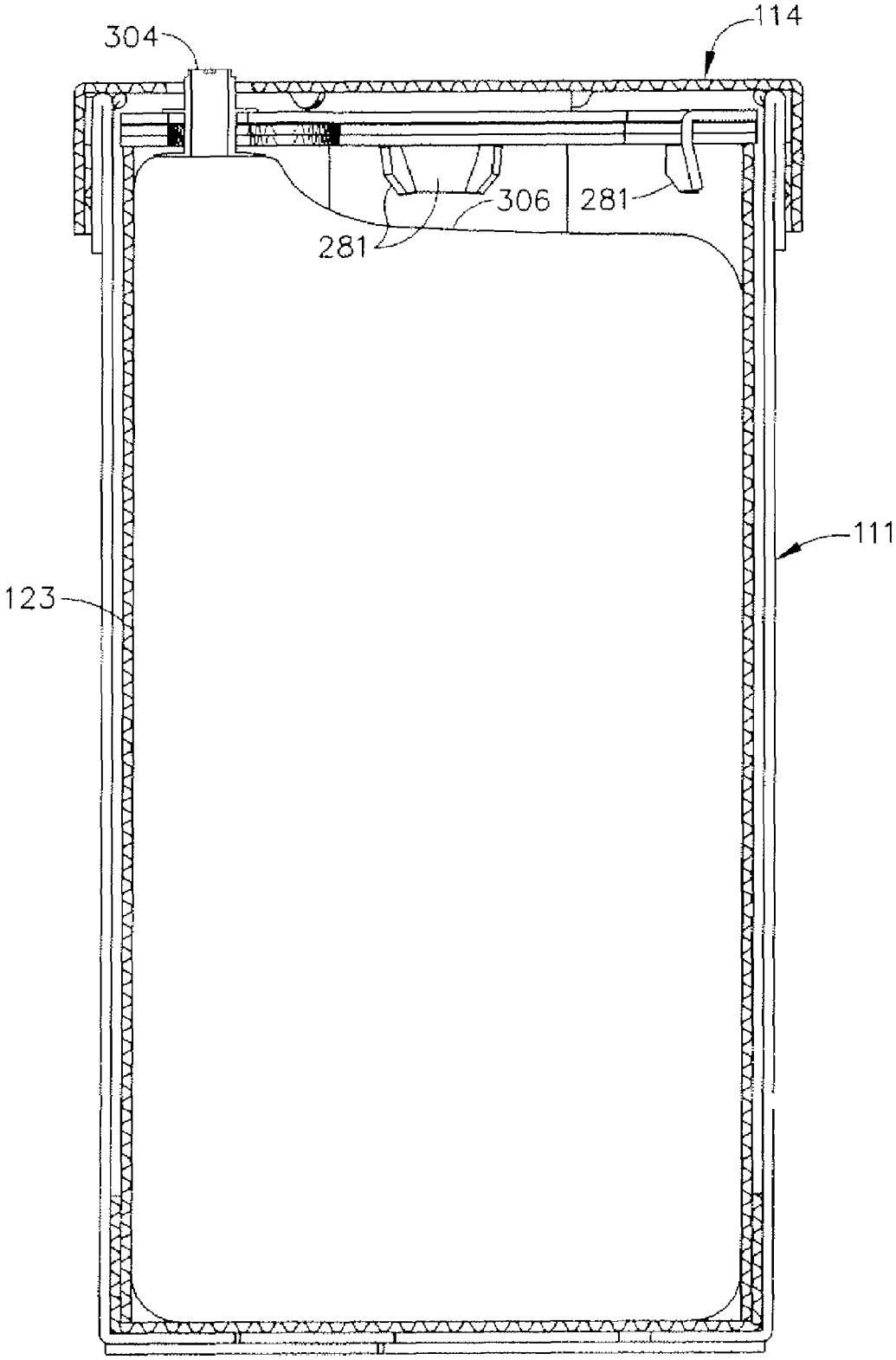
FIG. 50 is a cross-sectional view taken along line 50-50 in FIG. 49.

FIG. 50 illustrates a bag 306 including the discharge valve 304 assembled thereto disposed in the bin 111. The valve support tray 202, fill valve support plate 260, liner insert 202, and bin 111 are all made of multi-wall corrugated paperboard, such as double-wall board or triple-wall board. Such double-wall and triple-wall board used for containers is relatively strong to sustain heavy load forces, and is so stiff that it cannot be flexed with human strength. For example, the bin 111 preferably is triple wall CAA flute, and the tray insert, lid and liner preferably are single wall C flute. For increased strength, the direction of corrugations in the bin and liner can be extended at different angles. In a preferred embodiment, the flutes in the corrugated medium of the liner extend horizontally and the flutes of the corrugated medium in the bin extend vertically. The bag 306 is of liquid-impervious material of substantial strength and at its top, it has an inlet and outlet fittings which is fluid-conducting and is used for filling/discharging liquid from the container.

The use of the tray insert 122 and liner 202 may be optional, but it is preferred. The bin 111 of the invention is capable of shipping and storing liquid or semi-liquid if the tray insert and liner are omitted, but their use is preferred. Use of straps or bands is also optional but preferred.

In summary, the present invention is related to a bulk container for storing, shipping and dispensing liquid and semi-liquid fluids comprises a bin having a sidewall, a closed bottom, and an open top. The sidewall comprises a plurality of interconnected sidewall panels extending at an angle with respect to one another. A lid is covering the open top of the bin and having a discharge opening therethrough adjacent one side edge thereof. A fluid-containing bag is supported in the bin and a discharge valve is on an upper end of the bag where the discharge valve is positioned to extend through the discharge opening. Valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening.

a liner insert is in the container, the liner insert fitting closely in the bin sidewall and extending from the bin closed bottom to the bin open top, the bag being confined within the liner insert. The valve support means comprises transverse means extending across an upper end of the liner insert, and the valve support opening extends through the transverse means adjacent a side edge thereof. The liner insert is substantially coextensive in height with the bin sidewall and extends at the upper end thereof to the open top of the bin and the transverse means includes a valve support tray attached to the upper end of the liner insert. The locking means comprises a substantially flat, disc-shaped locking pad on top of the tray, the locking pad having an opening therethrough in aligned registry with the narrow end of the valve support opening, an edge of the opening through the locking pad engaging a side of the discharge valve to hold it in position in aligned registry with the discharge opening through the lid.

A plurality of liner slots are formed through the liner insert adjacent but spaced from the upper end thereof and the valve support tray has radially outwardly projecting tray tabs engaged in the liner slots to hold the tray in position on the liner insert. The valve support tray comprises a central panel having a plurality of upstanding tray flaps around an outer edge thereof and a plurality of liner flanges are foldably joined to the upper end of the liner insert, the flanges being folded downwardly over the tray flaps and in conjunction with the tray tabs hold the tray in fixed position on the liner insert. The tray flaps have cut-outs in bottom edges thereof forming tray slots around the periphery of the tray, and the locking pad has outwardly projecting tabs engaged in the tray slots to hold the locking pad against the central panel of the tray.

A plurality of locking pad slots are formed around an outer marginal edge of the locking pad, and bottom edges of the liner flanges have tabs thereon engaged in the locking pad slots to hold the liner flanges in folded position. A rim is on an upper outer surface of the bin sidewall for engagement by the tines of a forklift to lift and carry the container, the rim comprising an outwardly and downwardly folded rim flap on an upper edge of each the sidewall panel, the rim flaps is secured to an upper outer surface of a respective the sidewall panel in contiguous parallel relationship thereto and each presenting a downwardly facing shoulder having a length substantially the same as the width of an associated sidewall panel and a thickness capable of securely supporting the container on the tines of a forklift. The bin is octagonally shaped with eight interconnected the sidewall panels and associated the rim flaps. Recessed areas are formed in the rim at corners of the bin. The lid has a depending peripheral skirt extending downwardly over the rim and bendable strips are formed in the skirt of the lid in positions to be in registry with the recessed areas in the rim when the lid is in place on the bin, the bendable strips and recessed areas forming a lid locking means when the strips are pushed inwardly into the recessed areas.

A bin tray is in the bin where the bin tray is fitting closely in the bottom of the bin and the liner insert is fitting closely at a bottom end thereof in the bin tray and is extending at its other end to adjacent the upper end of the bin in closely fitting relationship against the sidewall of the bin. A reinforcing and retaining band is placed around the skirt of the lid, the band being received in depressions formed by pressing the bendable strips inwardly to lock the lid to the bin. The liner insert is shorter in height than bin sidewall and terminates at its upper end in downwardly spaced relationship to the open top and the transverse means comprises a valve support plate resting on the upper end of the liner insert, the valve support plate being engaged and held between the lid and the upper end of the liner insert. The valve support opening extends through the valve support plate and the locking means comprises a bendable valve tab on the valve support plate adjacent the valve support opening, the valve tab having one end foldably connected with the valve support plate and an opposite end engaging a side of the discharge valve to hold it the narrow end of the valve support opening and in position in aligned registry with the discharge opening through the lid.

The valve support plate comprises three foldably interconnected panels, including a top panel, a middle panel, and a bottom panel. A valve support opening is formed through each panel, the valve support opening through the middle and bottom panels having the keyhole shape with a wide end and a narrow end, and the opening through the top panel being circular and positioned to be in registry with the narrow end of the openings through the middle and bottom panels. The opposite end of the bendable valve tab has an arcuate cut-out defining one edge of the circular opening.

A transverse fold extends across the bendable valve tab at approximately a midportion thereof, whereby the bendable tab may be folded about the transverse fold to disengage the bendable tab from the discharge valve, or pushed down at the transverse fold to tend to straighten the bendable tab and urge the opposite end against the discharge valve to hold the discharge valve in the narrow end of the valve support openings and in aligned registry with the discharge opening through the lid. At least one assembly opening is formed through each of the middle and bottom panels of the valve support plate and at least one bendable assembly tab is foldably joined to the top panel and extends through the at least one assembly opening in the middle and bottom panels and is engaged below the bottom panel to hold the panels in assembled relationship. There are three assembly openings and associated bendable assembly tabs equally spaced around the valve support plate adjacent an outer edge thereof.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A bulk container for storing, shipping and dispensing liquid and semi-liquid fluids, comprising:

a bin having a sidewall, a closed bottom, and an open top, the sidewall comprising a plurality of interconnected sidewall panels extending at an angle with respect to one another;

a lid covering the open top of the bin, the lid having a discharge opening therethrough adjacent one side edge thereof;

a fluid-containing bag supported in the bin;

a discharge valve on an upper end of the bag, the discharge valve being positioned to extend through the discharge opening;

a liner insert disposed in the bin, a plurality of liner slots formed radially through the liner insert adjacent but spaced from an upper end thereof;

valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening; and the valve support means includes radially outwardly projecting tabs engaged with the corresponding liner slots to hold the valve support means in position on the liner insert.

2. The bulk container of claim 1,:

wherein the liner insert is fitting tightly in the bin sidewall and extending from the bin closed bottom to the bin open top, the bag being confined within the liner insert.

3. The bulk container of claim 2, wherein:

the valve support means comprises transverse means extending across an upper end of the liner insert, and the valve support opening extends through the transverse means adjacent a side edge thereof.

4. The bulk container of claim 3, wherein:

the liner insert is substantially coextensive in height with the bin sidewall and extends at the upper end thereof to the open top of the bin; and the transverse means includes a valve support tray attached to the upper end of the liner insert; and the locking means comprises a substantially flat, disc-shaped locking pad on top of the tray, the locking pad having an opening therethrough in aligned registry with the narrow end of the valve support opening, an edge of the opening through the locking pad engaging a side of the discharge valve to hold it in position in aligned registry with the discharge opening through the lid.

5. The bulk container of claim 4, wherein:

the valve support tray comprises a central panel having a plurality of upstanding tray flaps around an outer edge thereof; and a plurality of liner flanges are foldably joined to the upper end of the liner insert, the flanges being folded downwardly over the tray flaps and in conjunction with the tray tabs hold the tray in fixed position on the liner insert.

6. The bulk container of claim 5, wherein:

the tray flaps have cut-outs in bottom edges thereof, forming tray slots around the periphery of the tray, and the locking pad has outwardly projecting tabs engaged in the tray slots to hold the locking pad against the central panel of the tray.

7. A bulk container of claim 6, wherein:

a plurality of locking pad slots are formed around an outer marginal edge of the locking pad, and bottom edges of the liner flanges have tabs thereon engaged in the locking pad slots to hold the liner flanges in folded position.

8. The bulk container of claim 7, wherein:

a rim is on an upper outer surface of the bin sidewall for engagement by the tines of a forklift to lift and carry the container, the rim comprising an outwardly and downwardly folded rim flap on an upper edge of each the sidewall panel, the rim flaps being secured to an upper outer surface of a respective the sidewall panel in contiguous parallel relationship thereto and each presenting a downwardly facing shoulder having a length substantially the same as the width of an associated sidewall panel and a thickness capable of securely supporting the container on the tines of a forklift.

9. The bulk container of claim 8, wherein:

the bin is octagonally shaped, with eight interconnected the sidewall panels and associated the rim flaps.

10. The bulk container of claim 9, wherein:

recessed areas are formed in the rim at corners of the bin;

the lid has a depending peripheral skirt extending downwardly over the rim; and bendable strips are formed in the skirt of the lid in positions to be in registry with the recessed areas in the rim when the lid is in place on the bin, the bendable strips and recessed areas forming a lid locking means when the strips are pushed inwardly into the recessed areas.

11. The bulk container of claim 10, wherein:

a bin tray is in the bin, the bin tray fitting closely in the bottom of the bin and the liner insert fitting closely at a bottom end thereof in the bin tray and extending at its other end to adjacent the upper end of the bin in closely fitting relationship against the sidewall of the bin.

12. The bulk container of claim 11, wherein:

a reinforcing and retaining band is placed around the skirt of the lid, the band being received in depressions formed by pressing the bendable strips inwardly to lock the lid to the bin.

13. The bulk container of claim 3, wherein:

the liner insert is shorter in height than bin sidewall and terminates at its upper end in downwardly spaced relationship to the open top; and the transverse means comprises a valve support plate resting on the upper end of the liner insert, the valve support plate being engaged and held between the lid and the upper end of the liner insert.

14. The bulk container of claim 13, wherein:

the valve support opening extends through the valve support plate; and the locking means comprises a bendable valve tab on the valve support plate adjacent the valve support opening, the valve tab having one end foldably connected with the valve support plate and an opposite end engaging a side of the discharge valve to hold it the narrow end of the valve support opening and in position in aligned registry with the discharge opening through the lid.

15. The bulk container of claim 14, wherein:

the valve support plate comprises three foldably interconnected panels, including a top panel, a middle panel, and a bottom panel; and a valve support opening is formed through each panel, the valve support opening through the middle and bottom panels having the keyhole shape with a wide end and a narrow end, and the opening through the top panel being circular and positioned to be in registry with the narrow end of the openings through the middle and bottom panels.

16. The bulk container of claim 15, wherein:

the opposite end of the bendable valve tab has an arcuate cut-out defining one edge of the circular opening.

17. The bulk container of claim 16, wherein:

a transverse fold extends across the bendable valve tab at approximately a midportion thereof, whereby the bendable tab may be folded about the transverse fold to disengage the bendable tab from the discharge valve, or pushed down at the transverse fold to tend to straighten the bendable tab and urge the opposite end against the discharge valve to hold the discharge valve in the narrow end of the valve support openings and in aligned registry with the discharge opening through the lid.

18. The bulk container of claim 17, wherein:

at least one assembly opening is formed through each of the middle and bottom panels of the valve support plate; and at least one bendable assembly tab is foldably joined to the top panel and extends through the at least one assembly opening in the middle and bottom panels and is engaged below the bottom panel to hold the panels in assembled relationship.

19. The bulk container of claim 18, wherein:

there are three assembly openings and associated bendable assembly tabs equally spaced around the valve support plate adjacent an outer edge thereof.

20. A bulk container for storing, shipping and dispensing liquid and semi-liquid fluids, comprising:

a bin having a sidewall, a closed bottom, and an open top, the sidewall comprising a plurality of interconnected sidewall panels extending at an angle with respect to one another;

a lid covering the open top of the bin, the lid having a discharge opening therethrough adjacent one side edge thereof;

a fluid-containing bag supported in the bin;

a discharge valve on an upper end of the bag, the discharge valve being positioned to extend through the discharge opening;

valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening;

a liner insert being disposed in the container, the liner insert fitting closely in the bin sidewall and extending from the bin closed bottom to the bin open top, the bag being confined within the liner insert, the liner insert is shorter in height than bin sidewall and terminates at its upper end in downwardly spaced relationship to the open top; and the valve support means comprises transverse means extending across an upper end of the liner insert, the transverse means comprises a valve support plate resting on the upper end of the liner insert, the valve support plate being engaged and held between the lid and the upper end of the liner insert and wherein the valve support plate comprises three foldably interconnected panels, including a top panel, a middle panel, and a bottom panel and a valve support opening is formed through each panel, the valve support opening through the middle and bottom panels having the keyhole shape with a wide end and a narrow end, and the opening through the top panel being circular and positioned to be in registry with the narrow end of the openings through the middle and bottom panels.

21. A bulk container for storing, shipping and dispensing liquid and semi-liquid fluids, comprising:

a bin having a sidewall, a closed bottom, and an open top, the sidewall comprising a plurality of interconnected sidewall panels extending at an angle with respect to one another;

a lid covering the open top of the bin, the lid having a discharge opening therethrough adjacent one side edge thereof;

a fluid-containing bag supported in the bin;

a discharge valve on an upper end of the bag, the discharge valve being positioned to extend through the discharge opening; and valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening;

a liner insert disposed in the container, the liner insert fitting closely in the bin sidewall and extending from the bin closed bottom to the bin open top, the bag being confined within the liner insert, the liner insert being substantially coextensive in height with the bin sidewall and extends at the upper end thereof to the open top of the bin, a plurality of liner slots formed radially through the liner insert adjacent but spaced from an upper end thereof;

the valve support means comprises transverse means extending across an upper end of the liner insert, the transverse means includes a valve support tray attached to the upper end of the liner insert wherein the valve support tray includes radially outwardly projecting tabs engaged with the corresponding plurality of liner slots to hold the valve support means in position on the liner insert; and the locking means comprises a substantially flat, disc-shaped locking pad on top of the tray, the locking pad having an opening therethrough in aligned registry with the narrow end of the valve support opening, an edge of the opening through the locking pad engaging a side of the discharge valve to hold it in position in aligned registry with the discharge opening through the lid.

22. A bulk container for storing, shipping and dispensing liquid and semi-liquid fluids, comprising:

a bin having a sidewall, a closed bottom, and an open top, the sidewall comprising a plurality of interconnected sidewall panels extending at an angle with respect to one another;

a lid covering the open top of the bin, the lid having a discharge opening therethrough adjacent one side edge thereof;

a fluid-containing bag supported in the bin;

a discharge valve on an upper end of the bag, the discharge valve being positioned to extend through the discharge opening;

a liner insert disposed in the container;

a plurality of liner slots formed through the liner insert adjacent but spaced from an upper end thereof;

valve support means in an upper end of the bin for supporting and holding the discharge valve in position to extend through the discharge opening, the valve support means having a valve support opening therethrough with an elongate generally keyhole shape that is wide at one end and narrow at the other end, the narrow end being aligned with the discharge opening through the lid, the discharge valve being received through the narrow end of the valve support opening, and locking means engaged with the discharge valve to hold it in the narrow end of the valve support opening;

said valve support means comprises a transverse central panel having a plurality of upstanding flaps around an outer edge thereof, and radially outwardly projecting tabs engaged in the liner slots to hold the valve support means in position on the liner insert; and a plurality of liner flanges are foldably joined to the upper end of the liner insert, the flanges being folded downwardly over said upstanding flaps and in conjunction with said outwardly projecting tabs hold the valve support means in fixed position on the liner insert.

* * * * *